US006548232B2

(12) United States Patent
Goto

(10) Patent No.: US 6,548,232 B2
(45) Date of Patent: Apr. 15, 2003

(54) PHOTOTHERMOGRAPHIC MATERIAL AND PROCESSING METHOD THEREOF

(75) Inventor: Narito Goto, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/902,984

(22) Filed: Jul. 11, 2001

(65) Prior Publication Data

US 2002/0039707 A1 Apr. 4, 2002

(30) Foreign Application Priority Data

Jul. 12, 2000 (JP) ..... 2000-211278

(51) Int. Cl.[7] ..... G03C 1/498; G03C 5/16

(52) U.S. Cl. ..... 430/350; 430/523; 430/531; 430/619; 430/950

(58) Field of Search ..... 430/523, 619, 430/350, 950, 531

(56) References Cited

U.S. PATENT DOCUMENTS 5,866,504 A * 2/1999 Okada et al. ..... 503/200
6,124,042 A * 9/2000 Hashimoto ..... 430/480
6,344,313 B1 * 2/2002 Goto et al. ..... 430/619

FOREIGN PATENT DOCUMENTS

EP 0810467 * 12/1997 ..... G03C/1/498

* cited by examiner

*Primary Examiner*—Thorl Chea
(74) *Attorney, Agent, or Firm*—Muserlian, Lucas and Mercanti

(57) ABSTRACT

A photothermographic material is disclosed, comprising a support having thereon an image recording layer comprising an organic silver salt, a silver halide, a reducing agent and a binder, wherein the outermost surface of the image recording layer side of the photothermographic material exhibits a difference in center-line mean roughness of not more than 10 nm between before and after being subjected to thermal processing.

11 Claims, No Drawings

PHOTOTHERMOGRAPHIC MATERIAL AND PROCESSING METHOD THEREOF

FIELD OF THE INVENTION

The present invention relates to photothermographic materials and a processing method thereof.

BACKGROUND OF THE INVENTION

There are known a number of photosensitive materials comprising a support having thereon a photosensitive layer, which forms images upon imagewise exposure. Of these, techniques of forming images through thermal development are cited as a system suitable for environmental protection and simplifying image forming means. There are known thermally developable photothermographic materials comprising on a support having thereon an organic silver salt, silver halide grains, a reducing agent and a binder, as described, for example, in D. Morgan and B. Shely, U.S. Pat. Nos. 3,152,904 and 3,457,075, and D. Morgan, "Dry Silver Photographic Materials" (Handbook of Imaging Materials, Marcel Dekker, Inc. page 48, 1991), etc.

Such a photothermographic material contains a reducible light-insensitive silver source (such as organic silver salts), a catalytically active amount of photocatalyst (such as silver halide) and a reducing agent, which are dispersed in a binder matrix. The photothermographic materials are stable at ordinary temperature and forms silver upon heating, after exposure, at a relatively high temperature (e.g., 80° C. or higher) through an oxidation-reduction reaction between the reducible silver source (which functions as an oxidizing agent) and the reducing agent. The oxidation reduction reaction is accelerated by catalytic action of a latent image produced by exposure. Silver formed through reaction of the reducible silver salt in exposed areas provides a black image, which contrasts with non-exposes areas, leading to image formation. Such photothermographic materials meet requirements for simplified processing and environmental protection.

Such photothermographic materials have been mainly employed as photographic materials mainly for use in micrography and medical radiography, but partly for use in graphic arts. This is due to the fact that the maximum density (also denoted as Dmax) of obtained images is still low and the contrast is relatively low so that desired quality levels for graphic arts have not yet been achieved.

Along with advances in laser and light-emitting diodes, on the other hand, development of a recording material suitable for scanners having oscillating wavelengths at 700 to 800 nm and exhibiting enhanced sensitivity, relatively high density and high contrast is strongly desired.

U.S. Pat. No. 3,667,958 disclosed a photothermographic recording material employing the combination of polyhydroxybenzenes and hydroxyamines, reductones or hydrazines exhibits enhanced image quality discrimination and resolving power, but it was proved that such a combined use of reducing agents often caused increased fogging. U.S. Pat. Nos. 5,464,738 and 5,496,695 disclosed photothermographic materials containing an organic silver salt, silver halide, hindered phenols and hydrazine derivatives. However, the use of such hydrazine derivatives resulted in problems such that sufficiently high Dmax or contrast could not be obtained and black spots often resulted, deteriorating image quality. Hydrazine derivatives, improved in black spots were disclosed in JP-A Nos. 9-292671, 9-304870, 9-304871, 9-304872 and 10-31282 (hereinafter, the term, JP-A refers to unexamined, published Japanese Patent Application). Further, JP-A No. 10-62898 disclosed hydrazine derivatives resulting in improved image reproducibility but there were problems that a satisfactory level was not still achieved with respect to all of the maximum density, ultra-high contrast, improved black spots, dot reproducibility and dimensional stability. There were also such problems that the disclosed hydrazine derivatives led to inferior results in storage stability (such as increased fogging).

Recently, the desire for rapid access has becomes stronger. Specifically, in cases when a photothermographic material exhibiting relatively high maximum density and high contrast is subjected to rapid processing, problems are arose that roller marks or unevenness in density often occurs, leading to deteriorated image quality and it is desired to overcome such problems.

SUMMARY OF THE INVENTION

Accordingly, it is an object of the present invention to provide a photothermographic material causing no roller mark nor unevenness in density and exhibiting relatively high maximum density and high contrast, even when subjected to rapid processing, and a processing method by the use thereof.

The above object of the invention is achieved by the following constitution:

1. A photothermographic material comprising a support having thereon an image recording layer comprising an organic silver salt, a silver halide, a reducing agent and a binder, wherein the outermost surface of the image recording layer side of the photothermographic material exhibits a difference in center-line mean roughness (Ra) of not more than 10 nm between before and after being subjected to thermal processing;
2. the photothermographic material described in 1., wherein an absolute value of a thermal dimensional variation rate between before and after being subjected to the thermal processing is 0.001 to 0.04% in both the longitudinal direction and the traverse direction;
3. the photothermographic material described in 1., wherein a protective layer is provided on the image recording layer side and farther from the support than the image recording layer;
4. the photothermographic material described in 3., wherein the protective layer comprises a binder exhibiting a glass transition point of 75 to 200° C., and the binder of the image recoding layer exhibiting a glass transition point of 45 to 150° C.;
5. the photothermographic material described in 1., wherein the outermost surface of the image recording layer side of the photothermographic material exhibits an ultra-micro hardness of 1.1 to 4.0 GPa;
6. the photothermographic material described in 1., wherein the image recording layer further comprises a filler;
7. the photothermographic material described in 3., wherein the protective layer comprises a filler;
8. the photothermographic material described in 1., wherein at least 50% by weight of the binder contained in the image recording layer is accounted for by a polymeric latex;
9. the photothermographic material described in 8., wherein the image recording layer is formed by using a coating solution of the image recording layer, the coating solution containing water in an amount of at least 30% by weight, based on a solvent contained in the coating solution;

10. a processing method of a photothermographic material comprising:

subjecting a photothermographic material comprising a support having thereon an image recording layer comprising an organic silver salt, a silver halide, a reducing agent and a binder to thermal processing by use of a thermal processing machine, wherein the outermost surface of the image recording layer side of the photothermographic material exhibits a difference in center-line mean roughness (Ra) of not more than 10 nm between before and after being subjected to thermal processing;

11. the processing method described in 10., wherein the processing machine transports the photothermographic material at a rate of 22 to 40 mm/sec;

12. a photothermographic material comprising a support having thereon an image recording layer comprising an organic silver salt, a silver halide, a reducing agent and a binder, wherein a variation of center-line mean roughness (Ra) on the outermost surface of the image recording layer side of the photothermographic material is not more than 10 nm between before and after being subjected to thermal processing;

13. a method of processing a photothermographic material comprising a support having thereon an image recording layer containing an organic silver salt, a silver halide, a reducing agent and a binder by use of a thermal processing machine, wherein a variation of center-line mean roughness (Ra) on the outermost surface of the image recording layer side of the photothermographic material is not more than 10 nm between before and after being subjected to thermal processing;

14. the processing method described in 13, wherein an absolute value of a thermal dimensional variation in the longitudinal direction and the traverse direction is 0.001 to 0.04% when the photothermographic material is subjected to thermal development at a temperature of 120° C. for 30 sec.;

15. the photothermographic material described in 12., wherein at least 50% by weight of the total binder in the image recording layer is a polymeric latex, and at least 30% by weight of a solvent contained in a coating solution of the image recording layer is water;

16. the processing method of a photothermographic material described in 13., wherein at least 50% by weight of the total binder in the image recording layer is a polymeric latex, and at least 30% by weight of the solvent contained in the coating solution of the image recording layer is water;

17. the processing method of a photothermographic material described in any one of 13., 14. and 16., wherein the transport speed of the thermal processing machine is 22 to 40 mm/sec.

DETAILED DESCRIPTION OF THE INVENTION

The photothermographic materials relating to the invention comprise a support and an image recording layer. The image recording layer comprises an organic silver salt, a silver halide, a binder and a reducing agent. The difference (or variation) in center-line mean roughness (which is also denoted as Ra) between before and after being subjected to thermal processing is not more than 10 nm on the outermost surface of the image recording layer side of the photothermographic material. There may be provided another layer between the support and the image recoding layer. Examples of such a layer include a sublayer, an antistatic layer, an adhesion layer, and an antihalation layer. The image recording layer may be comprised of plural layers. Further on the image recording layer, other layer(s) may be provided, including a protective layer and an adhesion layer. There may be provided plural image recording layers.

As a result of the inventors' exploration of means for minimizing roller marks and unevenness in density occurring during thermal processing, it was proved that the foregoing object could be achieved by a photothermographic material in which the difference in center-line mean roughness (Ra) between before and after being subjected to thermal processing was within a specific range on the outermost surface of the image recording layer side. Thus, One aspect of the present invention is that the variation of the center-line mean roughness (Ra) between before and after being subjected to thermal processing is not more than 10 nm on the outermost surface of the image recording layer side, preferably 0 to 8 nm, and more preferably 1 to 6 nm. In the invention, the thermal processing means that the photothermographic material is allowed to pass through a pre-heating section at 110° C. for 15 sec. and then thermally developed at 120° C. for 15 sec., while being horizontally transported in an oven.

The difference in center-line mean roughness (Ra) between before and after being subjected to thermal processing being not more than 10 nm can be achieved by the optimal selection of the following technical means and combinations thereof.

1) A binder exhibiting a glass transition point (Tg) of 45 to 150° C. is selected as one for use in the image recording layer and a binder exhibiting a glass transition point (Tg) of 75 to 200° C., as one selected for use in a protective layer provided on the image recording layer.

2) The photothermographic material is so designed that the outermost surface of the image recording layer side exhibits an ultramicro hardness of 1.1 to 4 GPa (corresponding to 54 to 160 of a Vickers hardness). The ultramicro hardness of the coat can be controlled to an intended value by raising the glass transition point of the binder used to a relatively high value, by controlling the kind or amount of the incorporated filler, or by selecting an optimum cross-linking agent (such as poly-isocyanates, amines and silane coupling agents).

3) A filler (such as a water insoluble organic or inorganic compound) is incorporated into the image recording layer and/or the image recording layer-protective layer. The shape of the filler may be any of several forms, such as spherical, needle-like, tabular and scaly forms, is preferably a spherical or needle-like form, and more preferably a spherical form. In the case of the spherical form, the average particle diameter is 10 to 1000 nm, preferably 15 to 500 nm, and more preferably 20 to 150 nm; in the case of the needle form, the average major axis length is 50 to 5000 nm, preferably 80 to 1000 nm, and more preferably 100 to 500 nm. The amount to be incorporated is 1 to 50%, preferably 5 to 40%, and more preferably 10 to 30% by weight, based on the binder contained in the layer.

4) A photothermographic material is used, which exhibits an absolute value of a thermal dimensional variation rate of 0.001 to 0.04% both in the longitudinal direction and in the traverse direction, after the photothermographic material was thermally processed at a temperature of 120° C. for 30 sec. The absolute value of the thermal dimensional variation rate in the longitudinal traverse directions is preferably 0.005 to 0.03%, and more preferably 0.005 to 0.02%.

Herein, the thermal dimensional variation rate is defined as below:

Dimensional variation rate (%)={100×($L_2$−$L_1$)/$L_1$} where $L_1$ and $L_2$ are dimensions before and after being subjected to the thermal processing, respectively. Technical means for achieving the foregoing condition include, for example, the use of a support which has been subjected to a heat treatment under low tension, the use of a binder exhibiting a glass transition point of 75 to 200° C., and making the coating layer a three-dimensional network structure by using a cross-linking agent to enhance the Young's modulus or breaking strength.

5) Drying is preferably conducted under the following condition. After coating the image forming layer side, drying is carried out with wind at a temperature of 30 to 100° C. for not more than 7 min. The remaining solvent amount is preferably not more than 50 mg/$m^2$, more preferably not more than 5 mg/$m^2$, and still more preferably not more than 0.35 mg/$m^2$.

6) Prior to coating, all of coating solutions of the image forming layer-side are preferably allowed to pass through a filter having an absolute filtration precision of 5 to 50 nm at least one time.

7) In thermal processing, photothermographic materials are transported through a thermal processor, while the surface of the image forming layer side is brought into contact with the rollers and the opposite surface to the image forming layer side is brought into contact with a flat plate.

The center-line mean roughness (Ra) is defined based on the JIS surface roughness (JIS B0601), or ISO 468-1982.

Thus, the center-line mean roughness (Ra), when the roughness curve has been expressed by Y=f(X), is defined as a value, being expressed in nanometer (nm), that is obtained from the following equation 1, extracting a part of measuring length L in the direction of its center-line from the roughness curve, and taking the center-line of this extracted part as the X-axis and the direction of vertical magnification as the Y-axis:

$$Ra = \frac{1}{L}\int_0^L |f(x)|\,dx \qquad \text{equation 1}$$

The center-line mean roughness (Ra) can be determined in such a manner that measuring samples are allowed to stand in an atmosphere of 25° C. and 65% RH over a period of 24 hrs. under the condition that samples are not overlapped and then measured under the same atmosphere. The condition that samples are not overlapped include a method of taking up at the state of having film edges heightened, a method of overlapping with paper inserted between films and a method of inserting a four-cornered frame of thin paper. Examples of a measurement apparatus include RST/PLUS non-contact type three-dimensional micro surface shape measuring system, available from WYKO Co.

Binders usable in the image recording layer, image recording layer-protective layer, a backing layer and a sublayer are not specifically limited, and for example, any one of a hydrophobic resin and a hydrophilic resin may be used therein in accordance with suitability for each layer.

The hydrophobic resin exhibits advantages such as reduced fogging after thermal processing and preferred examples of the hydrophobic resin binder include polyvinyl butyral resin, cellulose acetate resin, cellulose acetate-butyrate resin, polyester resin, polycarbonate resin, polyacryl resin, polyurethane resin, and polyvinyl chloride resin. Of these, polyvinylbutyral resin, cellulose acetate resin, cellulose acetate-butyrate resin, polyester resin, and polyurethane resin are specifically preferred. Examples of the hydrophilic resin include polyacryl resin, polyester resin, polyurethane resin, polyvinyl chloride resin, polyvinylidene chloride resin, rubber type resin (e.g., SBR resin, NBR resin, etc.), polyvinyl acetate resin, polyolefin resin and polyvinyl acetal resin. The foregoing resins may be a copolymer comprised of two or more kinds of monomers, and may be straight-chained or branched. The resin may be cross-linked.

Such polymers are commercially available, and examples of commercially available acryl resin include Sevian A-4635, 46583, and 4601 (available from DAISEL CHEMICAL Ind. Ltd.), Nipol Lx811, 814, 821, 820, and 857 (available from NIHON ZEON Co. Ltd). Examples of polyester rein include FINETEX ES650, 611, 675, 850 (available from DAINIPPON INK CHEMICAL Co. Ltd.), and WD-size WMS (available from Eastman Kodak Corp.). Examples of polyurethane resin include HYDRAN AP10, 20, 30, 40, 101H, HYDRAN HW301, 310, and 350 (available from DAINIPPON INK CHEMICAL Co. Ltd.). Examples of vinylidene chloride resin include L502, L513, L123c, L106c, L111, and L114 (available from ASAHI CHEMICAL IND. Co. Ltd.); examples of vinyl chloride resin include G351 and G576 ((available from NIHON ZEON Co. Ltd.). Examples of olefin resin include CHEMIPAL S-120, S-300, SA-100, A-100, V-100, V-200, and V-300 (available from MITSUI PETROLEUM CHEMICAL IND. Co. Ltd.). Binders used in the invention may be used alone or in a blend.

These resins preferably contain at least one polar group selected from the group consisting of —$SO_3M$, —$OSO_3M$, —$PO(OM_1)_2$ and —$OPO(OM_1)_2$ (in which M is a hydrogen atom, an alkali metal such as Na, K and Li, or an alkyl group; and —$SO_3Na$, —$SO_3K$, —$OSO_3Na$ and —$OSO_3K$ are specifically preferred. The binder resin preferably exhibits a weight-averaged molecular weight of 5000 to 100000, and more preferably 10000 to 50000. Preferred examples of the binder resin used in the image recording layer include acryl resin, polyvinyl acetal resin, rubber type resin, polyurethane and polyester; and styrene-butadiene resin, polyurethane resin and polyester resin are specifically preferred. The glass transition point (Tg) of the binder resin is preferably 45 to 150° C., and more preferably 60 to 120° C. As a resin used in the image recording layer-protective layer or a backing layer are preferred cellulose resin, acryl resin and polyurethane. The glass transition point of such resins is preferably 75 to 200° C., and more preferably 100 to 160° C.

One feature of the photothermographic materials of the invention is that at least 50% by weight (preferably at least 65% and more preferably at least 80% by weight) of the binder contained in the image recording layer is preferably a polymeric latex (hydrophilic resin). The hydrophilic resin content of at least 50% by weight in the image recording layer leads to advantages such as an improvement in unevenness in density, superior transportability, enhanced manufacturing efficiency and superior friendliness to environments. Further, one feature of using the polymeric latex is the use of an aqueous solvent containing at least 30%, preferably at least 45%, and more preferably at least 60% by weight of water, as a coating solvent.

In one preferred embodiment of the invention, organic or inorganic compounds (used as a filler) are generally fine particles of water insoluble, organic or inorganic compounds, including organic compounds described in U.S. Pat. Nos. 1,939,213, 2,701,245, 2,322,037, 3,262,782, 3,539,344, and 3,767,448 and inorganic compounds described in 1,260,772, 2,192,241, 3,257,206, 3,370,951, 3,523,022 and 3,769,020. Exemplary examples of the organic compounds include aqueous-dispersible vinyl polymers such as polymethyl acrylate, polymethyl methacrylate, polyacrylonitrile, acrylonitrile-α-methylstyrene copolymer, polystyrene, styrene-divinylbenzene copolymer, polyvinyl acetate, polyethylene carbonate, and polytetrafluoroethylene; cellulose derivatives such as methyl cellulose, cellulose acetate, and cellulose acetate-propionate; starch derivatives such as carboxyl starch, carboxynitrophenyl starch, and a urea-formaldehyde-starch reaction product; gelatin hardened with commonly known hardening agents and a hardened gelatin in the form of coacervated microcro-capsule hollow particles. Of these, the use of polymethyl methacrylate is preferred. Preferred examples of the inorganic compounds include silicon dioxide, titanium dioxide, magnesium dioxide, aluminum oxide, barium sulfate, calcium carbonate, silver chloride or silver bromide desensitized by commonly know methods, glass and diatomaceous earth. Of these, silicon dioxide, titanium oxide, and aluminum oxide are preferred. The foregoing organic or inorganic compounds may be used in a blend. Further, in cases where the organic or inorganic compound is spherical, the average particle size thereof can be determined based on equivalent circle diameter electron-microscopically obtained from the particle projected area. In the case of needle-form particles, at least 100 particles are measured with respect to major axis length and average value thereof is defined as an average major-axis length.

The organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in RD17029 and RD29963, including organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (for example, aldehydes such as formaldehyde, acetaldehyde, butylaldehyde), hydroxy-substituted acids (for example, salicylic acid, benzoic acid, 3,5-dihydroxybenzoic acid, 5,5-thiodisalicylic acid, silver salts or complexes of thiones (for example, 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of fatty acids are preferred, and silver salts of behenic acid, arachidic acid and/or stearic acid are specifically preferred.

The organic silver salt compound can be obtained by mixing an aqueous-soluble silver compound with a compound capable of forming a complex. Normal precipitation, reverse precipitation, double jet precipitation and controlled double jet precipitation, as described in JP-A 9-127643 are preferably employed. For example, to an organic acid can be added an alkali metal hydroxide (e.g., sodium hydroxide, potassium hydroxide, etc.) to form an alkali metal salt soap of the organic acid (e.g., sodium behenate, sodium arachidate, etc.), thereafter, the soap and silver nitrate are mixed by the controlled double jet method to form organic silver salt crystals. In this case, silver halide grains may be concurrently present.

Silver halide grains of photosensitive silver halide in the present invention work as a light sensor. In order to minimize cloudiness after image formation and to obtain excellent image quality, the less the average grain size, the more preferred, and the average grain size is preferably less than 0.1 μm, more preferably between 0.01 and 0.1 μm, and still more preferably between 0.02 and 0.08 μm. The average grain size as described herein is defined as an average edge length of silver halide grains, in cases where they are so-called regular crystals in the form of cube or octahedron. Furthermore, in cases where grains are not regular crystals, for example, spherical, cylindrical, and tabular grains, the grain size refers to the diameter of a sphere having the same volume as the silver grain. Furthermore, silver halide grains are preferably monodisperse grains. The monodisperse grains as described herein refer to grains having a monodispersibility obtained by the formula described below of less than 40%; more preferably less than 30%, and most preferably from 0.1 to 20%.

$$\text{Monodispersibility}=(\text{standard deviation of grain diameter})/(\text{average grain diameter})\times 100(\%)$$

Silver halide grains used in the invention preferably exhibit an average grain diameter of not more than 0.1 μm and is monodisperse, and such a range of the grain size enhances image graininess.

The silver halide grain shape is not specifically limited, but a high ratio accounted for by a Miller index [100] plane is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

Furthermore, another preferred silver halide shape is a tabular grain. The tabular grain as described herein is a grain having an aspect ratio represented by r/h of at least 3, wherein r represents a grain diameter in μm defined as the square root of the projection area, and h represents thickness in μm in the vertical direction. Of these, the aspect ratio is preferably between 3 and 50. The grain diameter is preferably not more than 0.1 μm, and is more preferably between 0.01 and 0.08 μm. These are described in U.S. Pat. Nos. 5,264,337, 5,314,789, 5,320,958, and others. In the present invention, when these tabular grains are used, image sharpness is further improved. The composition of silver halide may be any of silver chloride, silver chlorobromide, silver iodochlorobromide, silver bromide, silver iodobromide, or silver iodide.

Silver halide emulsions used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V.L. Zelikman et al., Making and Coating of Photographic Emulsion (published by Focal Press, 1964).

Silver halide preferably occludes ions of metals belonging to Groups 6 to 11 of the Periodic Table. Preferred as the metals are W; Fe, Co, Ni, Cu, Ru, Rh, Pd, Re, Os, Ir, Pt and Au. These metals may be introduced into silver halide in the form of a complex.

Silver halide grain emulsions used in the invention may be desalted after the grain formation, using the methods known in the art, such as the noodle washing method and flocculation process.

The photosensitive silver halide grains used in the invention is preferably subjected to a chemical sensitization. As preferable chemical sensitizations, commonly known chemical sensitizations in this art such as a sulfur sensitization, a selenium sensitization and a tellurium sensitization are usable. Furthermore, a noble metal sensitization using gold, platinum, palladium and iridium compounds and a reduction sensitization are available.

In order to minimize cloudiness of the recording material, the total silver coverage including silver halide grains and organic silver salts is preferably 0.3 to 2.2 g/m$^2$, and more preferably 0.5 to 1.5 g/m$^2$. Such a silver coverage forms a relatively high contrast image. The silver halide amount is preferably not more than 50% by weight, and more preferably not more than 25% by weight, and still more preferably 0.1 to 15% by weight, based on the total silver coverage.

As spectral sensitizing dyes used in the invention are optionally employed those described in JP-A 63-159841, 60-140335, 63-231437, 63-259651, 63-304242, 63-15245; U.S. Pat. Nos. 4,639,414, 4,740,455, 4,741,966, 4,751,175, and 4,835,096. Further, sensitizing dyes usable in the invention are also described in Research Disclosure item 17643, sect. IV-A, page 23 (December, 1978) and ibid, item 1831, sect. X, page 437 (August, 1978). Sensitizing dyes suitable for spectral characteristics of various scanner light sources are advantageously selected, as described in JP-A 9-34078, 9-54409 and 9-80679.

The photothermographic material used in the invention preferably contains contrast-increasing agents. Examples of the contrast-increasing agents include hydrazine derivatives represented by formula (H), compounds represented by formula (G), quaternary onium compounds represented by formula (P), compounds represented by formulas (A) through (D), hydroxylamine compounds, alkanol amine compounds and phthalic acid ammonium compounds. First, hydrazine derivatives represented by the following formula (H) will be described:

formula (H)

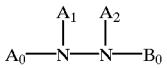

In the formula, $A_0$ is an aliphatic group, aromatic group, heterocyclic group, each of which may be substituted, or —$G_0$—$D_0$ group; $B_0$ is a blocking group; $A_1$ and $A_2$ are both hydrogen atoms, or one of them is a hydrogen atom and the other is an acyl group, a sulfonyl group or an oxalyl group, in which $G_0$ is a —CO—, —COCO—, —CS—, —C(=N$G_1D_1$)—, —SO—, —$SO_2$— or —P(O)($G_1D_l$)— group, in which $G_1$ is a linkage group, or a —O—, —S— or —N($D_1$)— group, in which $D_1$ is a hydrogen atom, or an aliphatic group, aromatic group or heterocyclic group, provided that when a plural number of $D_1$ are present, they may be the same with or different from each other and $D_0$ is an aliphatic group, aromatic group, heterocyclic group, amino group, alkoxy group, aryloxy group, alkylthio group or arylthio group.

In formula (H), an aliphatic group represented by $A_0$ of formula (H) is preferably one having 1 to 30 carbon atoms, more preferably a straight-chained, branched or cyclic alkyl group having 1 to 20 carbon atoms. Examples thereof are methyl, ethyl, t-butyl, octyl, cyclohexyl and benzyl, each of which may be substituted by a substituent (such as an aryl, alkoxy, aryloxy, alkylthio, arylthio, sulfooxy, sulfonamido, sulfamoyl, acylamino or ureido group).

An aromatic group represented by $A_0$ of formula (H) is preferably a monocyclic or condensed-polycyclic aryl group such as a benzene ring or naphthalene ring. A heterocyclic group represented by $A_0$ is preferably a monocyclic or condensed-polycyclic one containing at least one heteroatom selected from nitrogen, sulfur and oxygen such as a pyrrolidine-ring, imidazole-ring, tetrahydrofuran-ring, morpholine-ring, pyridine-ring, pyrimidine-ring, quinoline-ring, thiazole-ring, benzthiazole-ring, thiophene-ring or furan-ring. The aromatic group, heterocyclic group or —$G_0$—$D_0$ group represented by $A_0$ each may be substituted. Specifically preferred $A_0$ is an aryl group or —$G_0$—$D_0$ group.

$A_0$ contains preferably a non-diffusible group or a group for promoting adsorption to silver halide. As the non-diffusible group is preferable a ballast group used in immobile photographic additives such as a coupler. The ballast group includes an alkyl group, alkenyl group, alkynyl group, alkoxy group, phenyl group, phenoxy group and alkylphenoxy group, each of which has 8 or more carbon atoms and is photographically inert.

The group for promoting adsorption to silver halide includes a thioureido group, thiourethane, mercapto group, thioether group, thione group, heterocyclic group, thioamido group, mercapto-heterocyclic group or a adsorption group as described in JP A 64-90439.

In Formula (H), $B_0$ is a blocking group, and preferably —$G_0$—$D_0$, wherein $G_0$ is a —CO—, —COCO—, —CS—, —C(=N$G_1D_1$)—, —SO—, —$SO_2$— or —P(O)($G_1D_l$)— group, and preferred $G_0$ is a —CO—, —COCOA—, in which $G_1$ is a linkage, or a —O—, —S— or —N($D_1$)— group, in which $D_1$ represents a hydrogen atom, or an aliphatic group, aromatic group or heterocyclic group, provided that when a plural number of $D_1$ are present, they may be the same with or different from each other. $D_0$ is an aliphatic group, aromatic group, heterocyclic group, amino group, alkoxy group or mercapto group, and preferably, a hydrogen atom, or an alkyl, alkoxy or amino group. $A_1$ and $A_2$ are both hydrogen atoms, or one of them is a hydrogen atom and the other is an acyl group, (acetyl, trifluoroacetyl and benzoyl), a sulfonyl group (methanesulfonyl and toluenesulfonyl) or an oxalyl group (ethoxaly).

More preferred hydrazine compounds are represented by the following formulas (H-1), (H-2), (H-3) and (H-4):

formula (H-1)

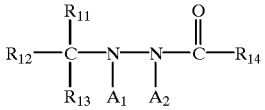

formula (H-2)

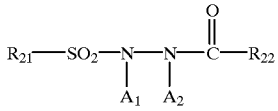

formula (H-3)

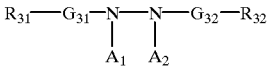

-continued formula (H-4)

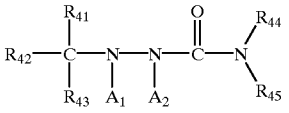

In formula (H-1), $R_{11}$, $R_{12}$ and $R_{13}$ are each a substituted or unsubstituted ary group or substituted or unsubstituted heteroary group (i.e., an aromatic heterocyclic group). Examples of the aryl group represented by $R_{11}$, $R_{12}$ or $R_{13}$ include phenyl, p-methylphenyl and naphthyl and examples of the heteroaryl group include a triazole residue, imidazole residue, pyridine residue, furan residue and thiophene residue. $R_{11}$, $R_{12}$ or $R_{13}$ may combine together with each other through a linkage group. Substituents which $R_{11}$, $R_{12}$ or $R_{13}$ each may have include, for example, an alkyl group, an alkenyl group, an alkynyl group, an aryl group, a heterocyclic group, a quaternary nitrogen containing heterocyclic group (e.g., pyridionyl), hydroxy, an alkoxy group (including containing a repeating unit of ethyleneoxy or propyleneoxy), an aryloxy group, an acyloxy group, an acyl group, an alkoxycarbonyl group, an aryloxycarbonyl group, a carbamoyl group, a urethane group, carboxy, an imodo group, an amino group, a carbonamido group, a sulfonamido group, a ureido group, a thioureido group, a sulfamoylamino group, semicarbazido group, thiosemocarbaido group, hydrazine group, a quaternary ammonio group, an alkyl-, aryl- or heterocyclic-thio group, mercapto group, an alkyl- or aryl-sufonyl group, an alkyl- or aryl-sulfinyl group, sulfo group, sulfamoyl group, an acylsufamoyl group, an alkyl or aryl-sulfonylureido group, an alkyl- or aryl-sulfonylcarbamoyl group, a halogen atom, cyano, nitro, and phosphoric acid amido group. All of $R_{11}$, $R_{12}$ and $R_{13}$ are preferably phenyl groups and more preferably unsubstituted phenyl groups.

$R_{14}$ is heterocyclic-oxy group or a heteroarylthio group. Examples of the heteroaryl group represented by $R_{14}$ include a pyridyloxy group, benzimidazolyl group, benzothiazolyl group, benzimidazolyloxy group, furyloxy group, thienyloxy group, pyrazolyloxy group, and imidazolyloxy group; and examples of the the heteroarylthio group include a pyridylthio group, pyrimidylthio group, indolylthio group, benzothiazolylthio, benzoimidazolylthio group, furylthio group, thienylthio group, pyrazolylthio group, and imidazolylthio group. $R_{14}$ is preferably a pyridyloxy or thenyloxy group.

$A_1$ and $A_2$ are both hydrogen atoms, or one of them is a hydrogen atom and the other is an acyl group (e.g., acetyl, trifluoroacetyl, benzoyl, etc.), a sulfonyl (e.g., methanesulfonyl, toluenesulfonyl, etc.), or oxalyl group (e.g., ethoxalyl, etc.). $A_1$ and $A_2$ are both preferably hydrogen atoms.

In formula (H-2), $R_{21}$ is a substituted or unsubstituted alkyl group, aryl group or heteroaryl group. Examples of the alkyl group represented by $R_{21}$ include methyl, ethyl, t-butyl, 2-octyl, cyclohexyl, benzyl, and diphenylmethyl; the aryl group, the heteroaryl group and the substituent groups are the same as defined in $R_{11}$, $R_{12}$ and $R_{13}$. In cases where $R_{21}$ is substituted, the substituent groups are the same as defined in $R_{11}$, $R_{12}$ and $R_{13}$. $R_{21}$ is preferably an aryl group or a heterocyclic group, and more preferably a phenyl group.

$R_{22}$ is a hydrogen atom, an alkylamino group, an arylamino group, or heteroarylamino group. Examples thereof include methylamino, ethylamino, propylamino, butylamino, dimethylamino, diethylamino, and ethylmethylamino. Examples of the arylamino group include an anilino group; examples of the heteroaryl group include thiazolylamino, benzimidazolylamino and benzthiazolylamino. $R_{22}$ is preferably dimethylamino or diethylamino $A_1$ and $A_2$ are the same as defined in formula (H-1).

In formula (H-3), $R_{31}$ and $R_{32}$ are each a univalent substituent group and the univalent substituent groups represented by $R_{31}$ and $R_{32}$ are the same as defined in $R_{11}$, $R_{12}$, and $R_{13}$ of formula (H-1), preferably an alkyl group, an aryl group, a heteroaryl group, an alkoxy group and an amino group, more preferably an aryl group or an alkoxy group, and specifically preferably, at least one of $R_{31}$ and $R_{32}$ t-butoxy and another preferred structure is that when $R_{31}$ is phenyl, $R_{32}$ is t-butoxycarbonyl.

$G_{31}$ and $G_{32}$ are each a —(CO)p— or —C(═S)— group, a sulfonyl group, a sulfoxy group, a —P(═O)$R_{33}$— group, or an iminomethylene group, in which $R_{33}$ is an alkyl group, an alkenyl group, an alkynyl group, an aryl group, an alkoxy group, an alkenyloxy group, an alkynyloxy group, an arylamino group or an amino group, provided that when $G_{31}$ is a sulfonyl group, $G_{32}$ is not a carbonyl group. $G_{31}$ and $G_{32}$ are preferably —CO—, —COCO—, a sulfonyl group or —CS—, and more preferably —CO— or a sulfonyl group. $A_1$ and $A_2$ are the same as defined in $A_1$ and $A_2$ of formula (H-1).

In formula (H-4), $R_{41}$, $R_{42}$ and $R_{43}$ are the same as defined in $R_{11}$, $R_{12}$ and $R_{13}$. $R_{41}$, $R_{42}$ and $R_{43}$ are preferably substituted or unsubstituted phenyl group, and more preferably all of $R_{41}$, $R_{42}$ and $R_{43}$ are an unsubstituted phenyl group. $R_{44}$ and $R_{45}$ are each an unsubstituted alkyl group and examples thereof include methyl, t-butyl, 2-octyl, cyclohexyl, benzyl, and diphenylmethyl. $R_{44}$ and $R_{45}$ are preferably ethyl. $A_1$ and $A_2$ are the same as defined in $A_1$ and $A_2$ of formula (H-1).

Exemplary examples of the compounds represented by formulas (H-1) through (H-4) are shown below but are by no means limited to these.

H-1-1

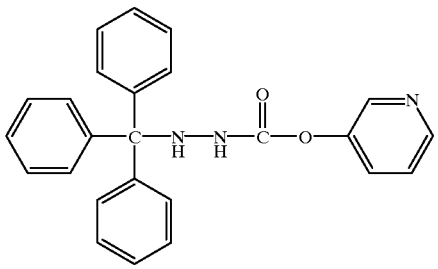

H-1-2

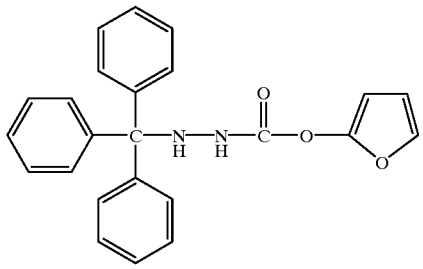

-continued
H-1-3
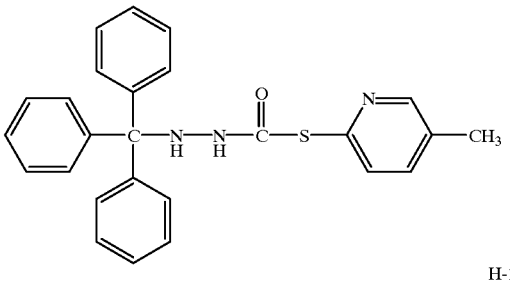
H-1-4
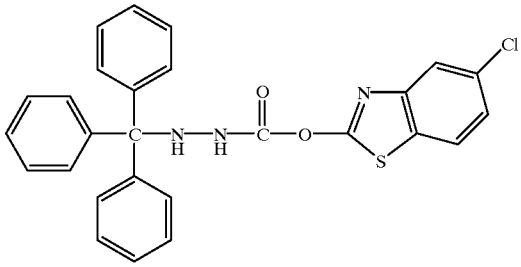
H-1-5
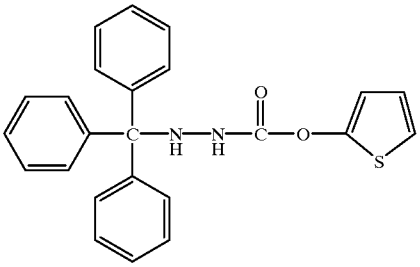
H-1-6
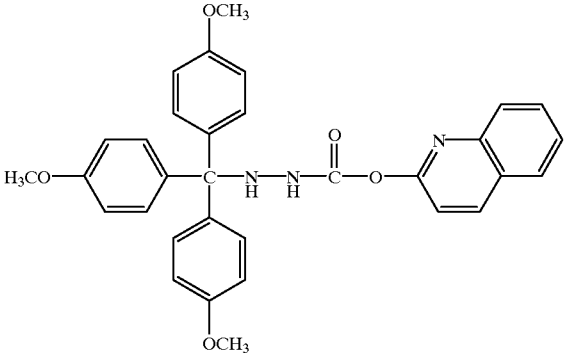
H-1-7
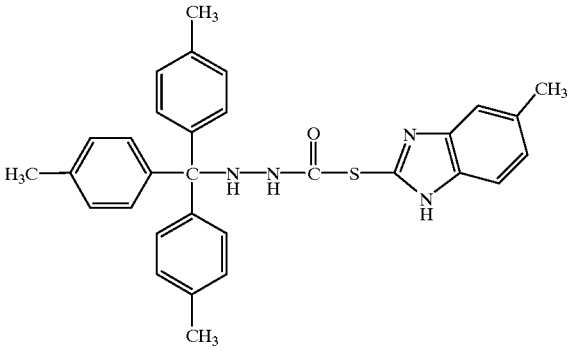
-continued
H-1-8
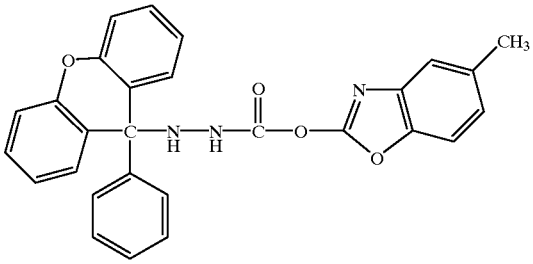
H-1-9
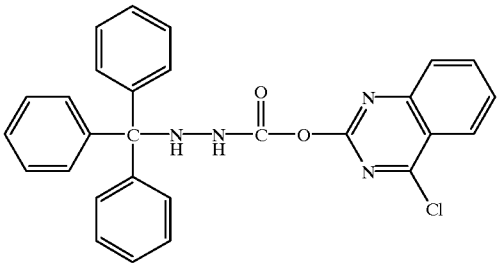
H-1-10
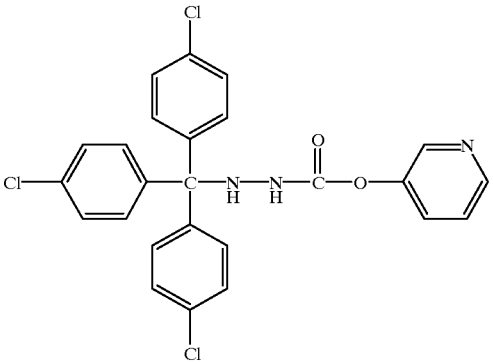
H-1-11
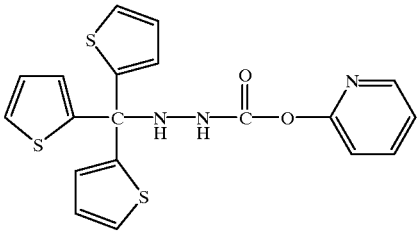
H-1-12
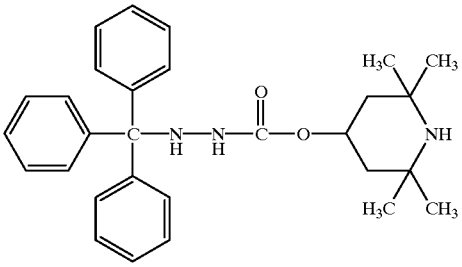

-continued
H-1-13
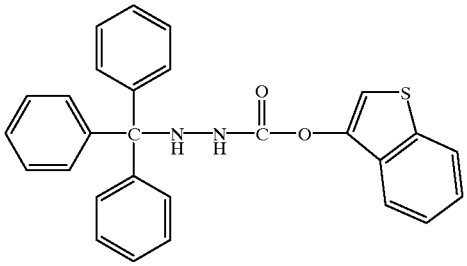
H-2-1
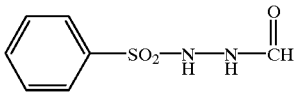
H-2-2
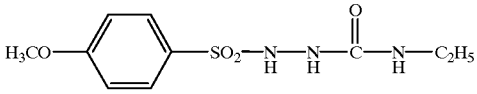
H-2-3
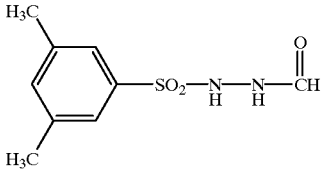
H-2-4
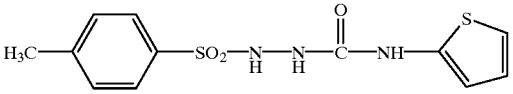
H-2-5
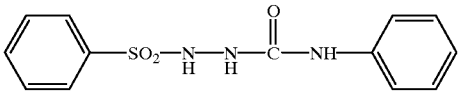
H-2-6
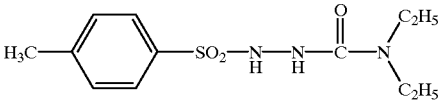
H-2-7
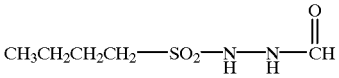
H-2-8
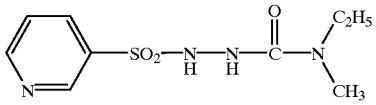
H-2-9
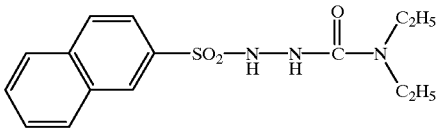
H-3-1
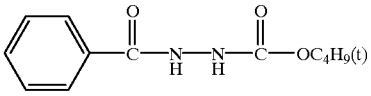
H-3-2
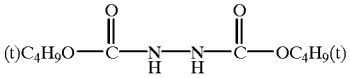
H-3-3
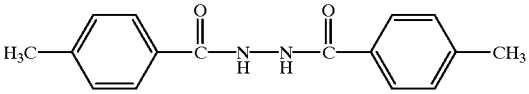
H-3-4
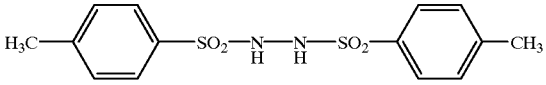
H-3-5
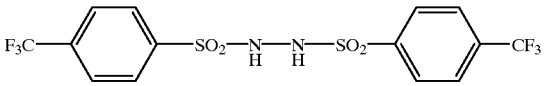
H-3-6
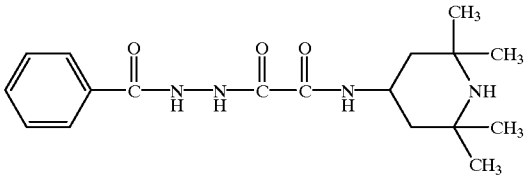
H-3-7
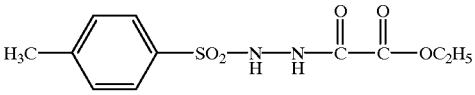
H-3-8
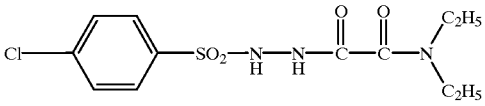
H-3-9
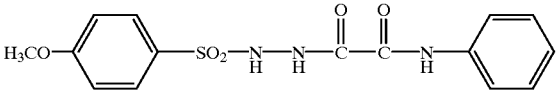
H-3-10
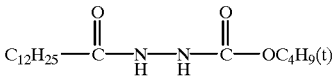
H-3-11
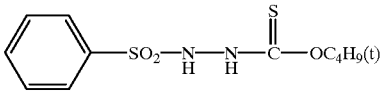
H-3-12
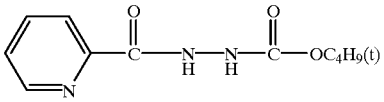

-continued

H-4-1

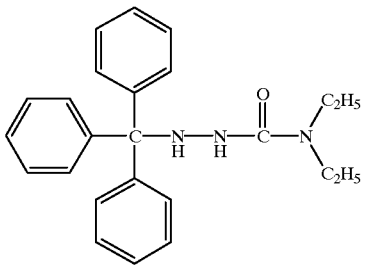

H-4-2

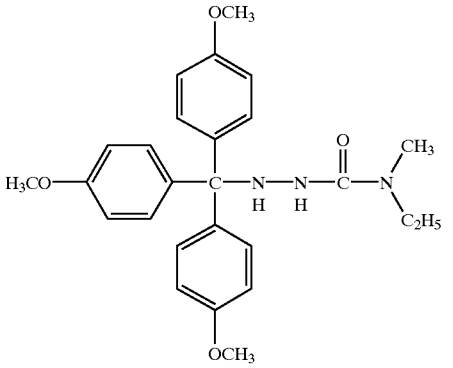

H-4-3

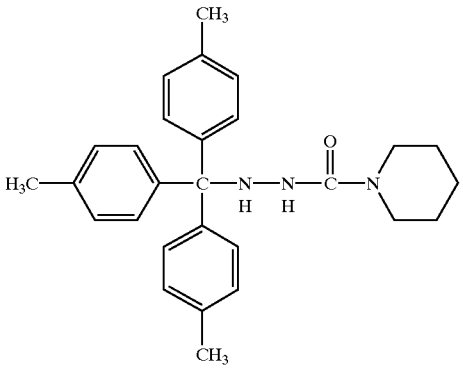

H-4-4

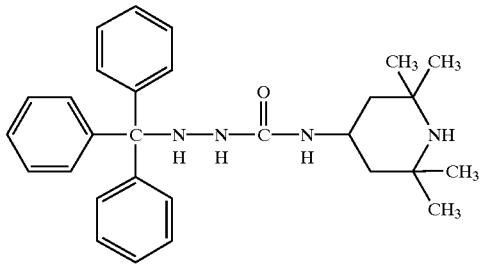

H-4-5

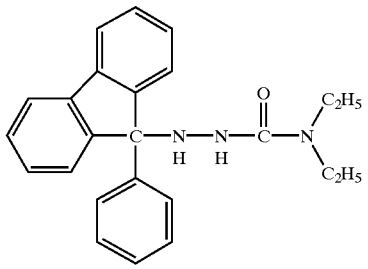

The compounds of formulas (H-1) through (H-4) can be readily synthesized in accordance with methods known in the art, as described in, for example, U.S. Pat. Nos. 5,467,738 and 5,496,695.

Furthermore, preferred hydrazine derivatives include compounds H-1 through H-29 described in U.S. Pat. No. 5,545,505, col. 11 to col. 20; and compounds 1 to 12 described in U.S. Pat. No. 5,464,738, col. 9 to col. 11. These hydrazine derivatives can be synthesized in accordance with commonly known methods.

Next, the compound represented by formula (G) will be described:

formula (G)

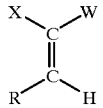

In formula (G), X and R are represented by a cis-form but a trans-form of X and R is also included in the invention.

In formula (G), X represents an electron-withdrawing group. The electron-withdrawing group refers to a substituent group having a negative Hammett's substituent constant σp. Examples thereof include a substituted alkyl group (e.g., halogen-substituted alkyl, etc.), a substituted alkenyl group (e.g., cyanoalkenyl, etc.), a substituted or unsubstituted alkynyl group (e.g., trifluoromethylacetylenyl, cyanoacetylenyl, etc.), a substituted or unsubstituted heterocyclic group (e.g., pyridyl, triazyl, benzoxazolyl, etc.), a halogen atom, an acyl group (e.g., acetyl, trifluoroacetyl, formyl, etc.), thioacetyl group (e.g., thioacetyl, thioformyl, etc.), an oxalyl group (e.g., methyloxalyl, etc.), an oxyoxalyl group (e.g., ethoxalyl, etc.), a thiooxalyl group (e.g., ethylthiooxalyl, etc.), an oxamoyl group (e.g., methyloxamoyl, etc.), an oxycarbonyl group (e.g., ethoxycarbonyl, etc.), carboxy group, a thiocarbonyl group (e.g., ethylthiocarbonyl, etc.), a carbamoyl group, a thiocarbamoyl group, a sulfonyl group, a sulfinyl group, an oxysulfonyl group (e.g., ethoxysulfonyl), a thiosulfonyl group (e.g., ethylthiosulfonyl, etc.), a sulfamoyl group, an oxysulfinyl group (e.g., methoxysulfinyl, etc.), a thiosulfinyl (e.g., methylthiosulfinyl, etc.), a sulfinamoyl group, phosphoryl group, a nitro group, an imino group, N-carbonylimino group (e.g., N-acetylimino, etc.), a N-sulfonylimino group (e.g., N-methanesufonylimono, etc.), a dicynoethylene group, an ammonium group, a sulfonnium group, a phophonium group, pyrilium group and inmonium group, and further including a group of a heterocyclic ring formed by an ammonium group, sulfonium group, phosphonium group or immonium group. Of these groups, groups exhibiting $\sigma_p$ of 0.30 or more are specifically preferred.

W is a hydrogen atom, an alkyl group, alkenyl group, an alkynyl group, an aryl group, a heterocyclic group, a halogen atom, an acyl group, a thioacyl group, an oxalyl group, an oxyaxalyl group, a thiooxalyl group, an oxamoyl group, an oxycarbonyl group, a thiocarbonyl group, a carbamoyl group, a thiocarbmoyl group, a sulfonyl group, a sulfinyl group, an oxysulfinyl group, a thiosulfinyl group, a sulfamoyl group, an oxysulfinyl group, a thiosulfinyl group, a sulfinamoyl group, a phosphoryl group, nitro group, an imino group, a N-carbonylimino group, a N-sulfonylimino group, a dicyanoethylene group, an ammonium group, a sulfonium group, a phosphonium group, pyrylium group, or an inmonium group. Examples of the alkyl group represented by W include methyl, ethyl and trifluoromethyl; examples of the alkenyl include vinyl, halogen-substituted vinyl and cyanovinyl; examples of the aryl group include nitrophenyl, cyanophenyl, and pentafluorophenyl; and examples of the heterocyclic group include pyridyl, pyrimidyl, triazinyl, succinimido, tetrazolyl, triazolyl, imidazolyl, and benzoxazolyl. The group, as W, exhibiting positive σp is preferred and the group exhibiting σp of 0.30 or more is specifically preferred.

R is a halogen atom, hydroxy, an alkoxy group, an aryloxy group, a heterocyclic-oxy group, an alkenyloxy group, an acyloxy group, an alkoxycarbonyloxy group, an aminocarbonyloxy group, a mercapto group, an alkylthio group, an arylthio group, a heterocyclic-thio group, an alkenylthio group, an acylthio group, an alkoxycarbonylthio group, an aminocarbonylthio group, an organic or inorganic salt of hydroxy or mercapto group (e.g., sodium salt, potassium salt, silver salt, etc.), an amino group, a cyclic amino group (e.g., pyrrolidine), an acylamino group, anoxycarbonylamino group, a heterocyclic group (5- or 6-membered nitrogen containing heterocyclic group such as benztriazolyl, imidazolyl, triazolyl, or tetrazolyl), a ureido group, or a sulfonamido group. X and W, or X and R may combine together with each other to form a ring. Examples of the ring formed by X and W include pyrazolone, pyrazolidinone, cyclopentadione, β-ketolactone, and β-ketolactam. Of the groups represented by R, a hydroxy group, a mercapto group, an alkoxy group, an alkylthio group, a halogen atom, an organic or inorganic salt of a hydroxy or mercapto group and a heterocyclic group are preferred, and a hydroxy group, a mercapto group and an organic or inorganic salt of a hydroxy or mercapto group are more preferred.

Of the groups of X and W, the group having a thioether bond is preferred.

Next, the compound represented by formula (P) will be described:

formula (P)

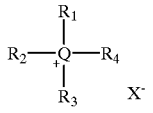

In formula (P), Q is a nitrogen atom or a phosphorus atom; $R_1$, $R_2$, $R_3$ and $R_4$ each are a hydrogen atom or a substituent, provided that $R_1$, $R_2$, $R_3$ and $R_4$ combine together with each other to form a ring; and $X^-$ is an anion.

Examples of the substituent represented by $R_1$, $R_2$, $R_3$ and $R_4$ include an alkyl group (e.g., methyl, ethyl, propyl, butyl, hexyl, cyclohexyl), alkenyl group (e.g., allyl, butenyl), alkynyl group (e.g., propargyl, butynyl), aryl group (e.g., phenyl, naphthyl), heterocyclic group (e.g., piperidyl, piperazinyl, morpholinyl, pyridyl, furyl, thienyl, tetrahydrofuryl, tetrahydrothienyl, sulforanyl), and amino group. Examples of the ring formed by $R_1$, $R_2$, $R_3$ and $R_4$ include a piperidine ring, morpholine ring, piperazine ring, pyrimidine ring, pyrrole ring, imidazole ring, triazole ring and tetrazole ring. The group represented by $R_1$, $R_2$, $R_3$ and $R_4$ may be further substituted by a hydroxy group, alkoxy group, aryloxy group, carboxy group, sulfo group, alkyl group or aryl group. Of these, $R_1$, $R_2$, $R_3$ and $R_4$ are each preferably a hydrogen atom or an alkyl group. Examples of the anion of $X^-$ include a halide ion, sulfate ion, nitrate ion, acetate ion and p-toluensulfonic acid ion.

Further, quaternary onium compounds usable in this invention include compounds represented by formulas (Pa), (Pb) and (pc), or formula (T):

formula (Pa)

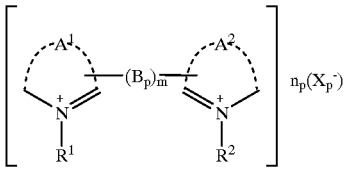

formula (Pb)

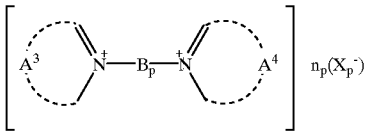

formula (Pc)

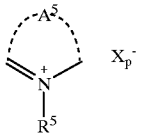

wherein $A^1$, $A^2$, $A^3$, $A^4$ and $A^5$ are each a nonmetallic atom group necessary to form a nitrogen containing heterocyclic ring, which may further contain an oxygen atom, nitrogen atom and a sulfur atom and which may condense with a benzene ring. The heterocyclic ring formed by $A^1$, $A^2$, $A^3$, $A^4$ or $A^5$ may be substituted by a substituent. Examples of the substituent include an alkyl group, an aryl group, an aralkyl group, alkenyl group, alkynyl group, a halogen atom, an acyl group, an alkoxycarbonyl group, an aryloxycarbonyl group, a sulfo group, hydroxy, an alkoxyl group, an aryloxy group, an amido group, a sulfamoyl group, a carbamoyl group, a ureido group, an amino group, a sulfonamido group, cyano, nitro, a mercapto group, an alkylthio group, and an arylthio group. Exemplary preferred $A^1$, $A^2$, $A^3$, $A^4$ and $A^5$ include a 5- or 6-membered ring (e.g., pyridine, imidazole, thiazole, oxazole, pyrazine, pyrimidine) and more preferred is a pyridine ring.

Bp is a divalent linkage group, and m is 0 or 1. Examples of the divalent linkage group include an alkylene group, arylene group, alkenylene group, —$SO_2$—, —SO—, —O—, —S—, —CO—, —N($R^6$)—, in which $R^6$ is a hydrogen atom, an alkyl group or aryl group. These groups may be included alone or in combination. Of these, Bp is preferably an alkylene group or alkenylene group.

$R^1$, $R^2$ and $R^5$ are each an alkyl group having 1 to 20 carbon atoms, and $R^1$ and $R^2$ may be the same. The alkyl group may be substituted and substituent thereof are the same as defined in $A^1$, $A^2$, $A^3$, $A^4$ and $A^5$. Preferred $R^1$, $R^2$ and $R^5$ are each an alkyl group having 4 to 10 carbon atoms, and more preferably an aryl-substituted alkyl group, which may be substituted. $X_p^-$ is a counter ion necessary to counterbalance overall charge of the molecule, such as chloride ion, bromide ion, iodide ion, sulfate ion, nitrate ion and p-toluenesulfonate ion; $n_p$ is a counter ion necessary to counterbalance overall charge of the molecule and in the case of an intramolecular salt, $n_p$ is 0.

Formula (T)

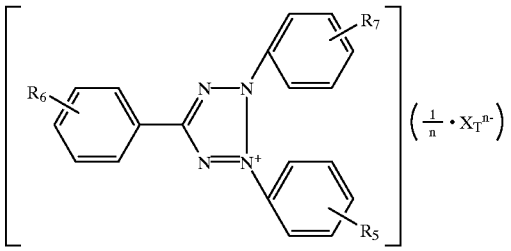

In formula (T), substituent groups $R_5$, $R_6$ and $R_7$, substituted on the phenyl group are preferably a hydrogen atom or a group, of which Hammett's σ-value exhibiting a degree of electron attractiveness is negative.

The σ values of the substituent on the phenyl group are disclosed in lots of reference books. For example, a report by C. Hansch in "The Journal of Medical Chemistry", vol.20, on page 304(1977), etc. can be mentioned. Groups showing particularly preferable negative a-values include, for example, methyl group ($\sigma_p$=−0.17, and in the following, values in the parentheses are in terms of $\sigma_p$ value), ethyl group(−0.15), cyclopropyl group(−0.21), n-propyl group(−0.13), iso-propyl group(−0.15), cyclobutyl group(−0.15), n-butyl group(−0.16), iso-butyl group(−0.20), n-pentyl group(−0.15), n-butyl group(−0.16), iso-butyl group(−0.20), n-pentyl group(−0.15), cyclohexyl group(−0.22), hydroxyl group(−0.37), amino group(−0.66), acetylamino group(−0.15), butoxy group(−0.32), pentoxy group(−0.34), etc. can be mentioned. All of these groups are useful as the substituent for the compound represented by the formula T according to the present invention; n is 1 or 2, and as anions represented by $X_T^{n-}$ for example, halide ions such as chloride ion, bromide ion, iodide ion, etc.; acid radicals of inorganic acids such as nitric acid, sulfuric acid, perchloric acid, etc.; acid radicals of organic acids such as sulfonic acid, carboxylic acid, etc.; anionic surface active agents, including lower alkyl benzenesulfonic acid anions such as p-toluenesulfonic anion, etc.; higher alkyl benzenesulfonic acid anions such as p-dodecyl benzenesulfonic acid anion, etc.; higher alkyl sulfate anions such as lauryl sulfate anion, etc.; Boric acid-type anions such as tetraphenyl borone, etc.; dialkylsulfo succinate anions such as di-2-ethylhexylsulfo succinate anion, etc.; higher fatty acid anions such as cetyl polyethenoxysulfate anion, etc.; and those in which an acid radical is attached to a polymer, such as polyacrylic acid anion, etc. can be mentioned. The quaternary onium salt compounds described above can be readily synthesized according to the methods commonly known in the art. For example, the tetrazolium compounds described above may be referred to Chemical Review 55, page 335–483.

Compounds represented by the following formulas (a) through (D), and hydroxylamine, alkanolamine and ammonium phthalate are also preferably used:

formula (A)

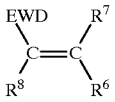

-continued formula (B)

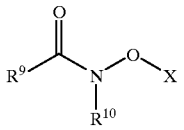

formula (C)

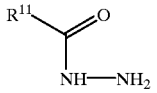

formula (D)

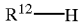

In formula (A), EWD represents an electron-withdrawing group; $R^6$, $R^7$ and $R^8$ each represent a hydrogen atom or a univalent substituent group, provided that at least one of $R^6$, $R^7$ and $R^8$ is a univalent substituent group. The electron-withdrawing group represented by EWD refers to a substituent group exhibiting a positive Hammett's substituent constant (σp). Examples thereof include cyano group, an alkoxycarbonyl group, an aryloxycarbonyl group, a carbamoyl group, a sulfamoyl group, an alkylsulfonyl group, an arylsulfonyl group, nitro group, a halogen atom, a perfluoroalkyl group, an acyl group, a formyl group, a phosphryl group, a carboxy group (or its salt), a sulfo group (or its salt), saturated or unsaturated heterocyclic group, an alkenyl group, an alkynyl group, an acyloxy group, an acylthio group, a sulfonyloxy group, and an aryl group substituted with these electron-withdrawing groups. Exemplary compounds are described in U.S. Pat. No. 5,545,515.

Next, the compound represented by formula (B) will be described. In formula (B), $R^9$ represents a hydrogen atom, an alkyl group, an alkenyl group, an alkoxy group, an alkylthio group, an amido group, an aryl group, an aralkyl group, an aryloxy group, an arylthio group, an anilino group, a heterocyclic group, a heterocyclic-oxy group, and a heterocyclic-thio group. Specifically, the alkyl group is preferably methyl or ethyl.

$R^{10}$ represents a hydrogen atom, an alkyl group, an alkenyl group, an alkyl group, an alkoxy group, an alkylthio group, an amido group, an aryl group, an aralkyl group, an aryloxy group, an arylthio group, an anilino group, a heterocyclic group, a heterocyclic-oxy group, and a heterocyclic-thio group. a hydrazine group, an alkylamino group, a sulfonylamino group, a ureido group, an oxycarbonylamino group, and unsubstituted amino group. Of these, an aryl group, a heterocyclic group, a heterocyclic-oxy group and a heterocyclic-thio group are preferable, and a heterocyclic-oxy group and a heterocyclic-thio group are more preferable. Examples of the heterocyclic-oxy group and heterocyclic thio group include pyridyloxy, pyrimidyloxy, indolyloxy, benzthiazolyloxy, benzimidazolyloxy, furyloxy, thienyloxy, pyrazolyloxy, indazolyloxy, furylthio, thienylthio, pyrazolylthio and indazolylthio. Of these, pyridyloxy and thienyoxy are preferred. X represents a hydrogen atom, a carbamoyl group or an oxycarbonyl group, and X is preferably a hydrogen atom. $R^9$ and $R^{10}$ may combine with each other to a ring. Exemplary compounds of formula (B) are described in U.S. Pat. No. 5,545,507.

Next, the compound represented by formula (C) will be described. In formula (C), $R^{11}$ represents an alkyl group, an alkenyl group, an alkoxy group, an alkylthio group, an amido group, an aryl group, an aralkyl group, an aryloxy group, an arylthio group, an anilino group, a heterocyclic group, a heterocyclic-oxy group and a heterocyclic-thio group. Of these, a heterocyclic-oxy group and a heterocyclic-thio group are preferable. Examples of the heterocyclic-oxy group and heterocyclic-thio group include pyridyloxy, pyrimidyloxy, indolyloxy, benzthiazolyloxy, benzimidazolyloxy, furyloxy, thienyloxy, pyrazolyloxy, and indazolyloxy. Examples of the heterocyclic-thio group include pyridylthio, pyrimidylthio, indolylthio, benzolylthio, benzimidazolylthio, furylthio, thienylthio, pyrazolylthio and indazolylthio. Of these, pyridyloxy and thienyloxy are preferable. Exemplary compounds are described in U.S. Pat. No. 5,558,983.

Next, the compound represented by formula (D) will be described. In formula (D), $R^{12}$ represents a benzhydrol nucleus, diphenylphosphine nucleus, triphenylmethane nucleus, N,N'-dialkylpiperazine nucleus, 3-pyrroline nucleus, xanthene nucleus, 9,10-dihysroxyanthracene nucleus, 9-hydroxyfluorene, aryl-α-ketoester nucleus, aldehyde nucleus, alkyl-β-ketoester nucleus, oxime nucleus, amidoxime nucleus, benzaldehydeoxime nucleus, acetophenoneoxime nucleus, caprolactam oxime nucleus, ethylbenzoate nucleus, pivaldehyde nucleus or ethylisobutylacetate nucleus. Exemplary compounds thereof are described in U.S. Pat. No. 5,637,449.

Exemplary examples of the compounds represented by formulas (A) through (D) are shown below but are by no means limited to these.

A1

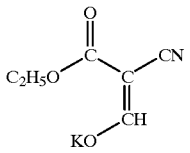

A2

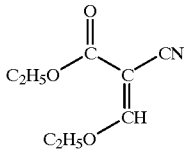

A3

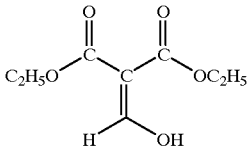

A4

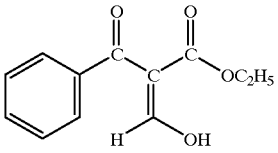

B1

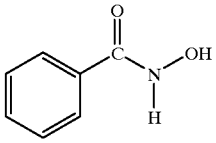

-continued

B2

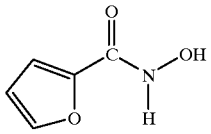

B3

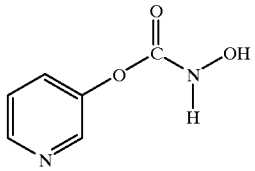

B4

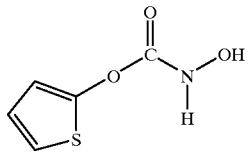

C1

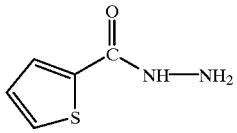

C2

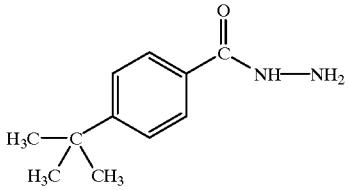

C3

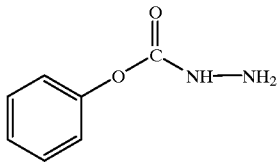

C4

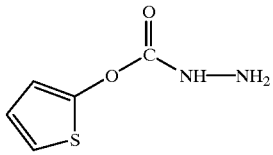

D1

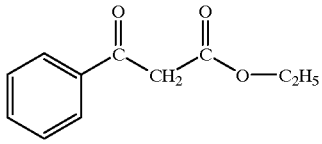

D2

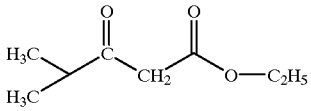

The compounds represented by formulas (A) through (D) are incorporated preferably in an amount of $1\times10^{-6}$ to 1 mole, and more preferably $1\times10^{-5}$ to $5\times10^{-1}$ mol per mole of silver.

Reducing agents used in the invention are preferably included in the photothermographic material. Suitable reducing agents are exemplarily described in U.S. Pat. Nos. 3,770,448, 3,773,512, 3,593,863; Research Disclosure Nos. 17029 and 29963. Examples thereof include aminohydroxycycloalkenone compounds (e.g., 2-hydroxy-3-pyridino-2-cyclohexene); as a reducing agent precursor, aminoreductone esters (e.g., piperidinohexose reductone monoacetate); N-hydroxyurea derivatives (e.g., N-p-methylphenyl-N-hydroxyurea); hydrazones of aldehydes or ketones (e.g., anthracenealdehyde phenylhydrazone); phosphuramidophenols; phosphuramidoanilines; polyhydroxybenzenes (e.g., hydroquinone, t-butylhydroquinone, isopropylhydroquinone, 2,5-(dihydroxyphenyl)methylsulfone); sulfhydoxamic acids (e.g., benzenesulfhydroxamic acid); sulfonamidoanilines (e.g., 4-(N-methanesulfonamido)aniline); 2-tetrazolylthiohydroquinones(2-methyl-5-(1-phenyl-5-tetrazolylthio)hydroquinone); tetrahydroquinoxalines (e.g., 1,2,3,4-tetrahydroquinoxaline); amidoximes; azines; a combination of aliphatic carboxylic acid arylhydraxides and ascorbic acid; a combination of polyhydroxybenzenes and hydroxamic acids; reductones and/or hydrazines; hydroxamic acids; a combination of azines and sulfonamidophenols; α-cyanophenylacetic acid derivatives; a combination of bis-β-naphthol and 1,3-dihydroxybenzebe derivatives; 5-pyrazolones; sulfonamidophenol reducing agents; 2-phenylindane-1,3-dione; chroman; 1,4-dihydroxypyridines e.g., 2,6-dimethoxy-3,5-dicarboxy-1,4-dihydropyridine); bisphenols [e.g., bis(2-hydroxy-3-t-butyl-5-methylphenol)methane, bis(6-hyroxy-m-tri)mesitol, 2,2-bis(4-hydroxy-3-methylphenyl)propane, 4,4-ethylidene-bis(2-t-butyl-6-methylphenol)]; UV ray-sensitive ascorbic acid derivatives; hindered phenols; and 3-pyrazolidones. Of these, hindered phenols are specifically preferable. Preferred hindered phenols are represented by the following formula (A'):

formula (A)

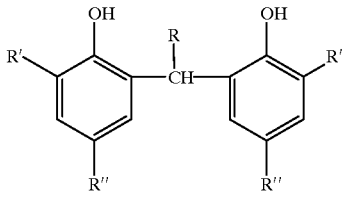

wherein R represents a hydrogen atom or an alkyl group having from 1 to 10 carbon atoms (for example, isopropyl, —$C_4H_9$, 2,4,4-trimethylpentyl), and R' and R" each represents an alkyl group having from 1 to 5 carbon atoms (for example, methyl, ethyl, t-butyl).

The amount of the reducing agent to be incorporated is preferably 0.1 to 2 moles, and more preferably 0.1 to 1 moles per mole of the total silver of an organic silver salt and silver halide.

Photothermographic materials relating to the invention preferably contain oxidizing agents. Oxidizing agents usable in the invention may be any one as long as it is capable of reducing fogging caused during storage. Preferred examples of oxidizing agents are described in JP-A 50-119624, 50-120328, 51-121332, 54-58022, 56-70543, 56-99335, 59-90842, 61-129642, 62-129845, 6-208191, 7-5621, 7-2781, 8-15809; U.S. Pat. Nos. 5,340,712, 5,369,000, 5,464,737, 3,874,946, 4,756,999, 5,340,712; European Patent Nos. 605981A1, 622666A1, 631176A1; JP-B 54-165, 7-2781; U.S. Pat. Nos. 4,180,665 and 4,442,202. Specifically, polyhalogenide compounds represented by the following formula (I) are preferred:

formula (I)

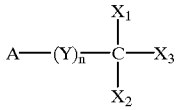

In the formula, A represents an aliphatic group, an aromatic group or a heterocyclic group; $X_1$, $X_2$ and $X_3$ each represent a hydrogen atom or an electron-withdrawing group, which may be either the same or different; Y represents a bivalent linkage group; and n is 0 or 1.

In the invention, the oxidizing agent is incorporated preferably in an amount of $1\times10^{-4}$ to 1 mole, and more preferably $1\times10^{-3}$ to 0.5 mole per mol of silver.

It is preferred to incorporate a fatty acid or its derivatives into at least one layer of the image recording layer side of the photothermographic material. Examples of fatty acids include lauric acid, myristic acid, palmitic acid, stearic acid, behenic acid, oleic acid, linoleic acid, linolenic acid and elaidic acid; and examples of fatty acid esters include butyl stearate, amyl stearate, octyl stearate, butyl palmitate, butyl myristate, butoxyethyl stearate, oleyl olate and butoxyethyl stearate.

The image recording layer or protective layer preferably contains a filler. The filler is preferably inorganic material. Organic material fillers preferably are those exhibiting a glass transition point of not less than 80° C., and more preferably not less than 100° C. and not more than 200° C.

Supports used for the photothermographic materials include, for example, paper, polyethylene-laminated paper, polypropylene-laminated paper, parchment, cloth, sheets or foils of metals (e.g., aluminum, copper, magnesium, zinc, etc.), glass, glass coated with metals (such as chromium alloy, steal, silver, gold, platinum, etc.) and plastic resin films. Examples of plastic resin used as a support include polyalkyl methacrylate (e.g., polymethyl methacrylate), polyesters (e.g., polyethylene terephthalate), polyvinyl acetal, polyamides (e.g., nylon), and cellulose esters (e.g., cellulose nitrate, cellulose acetate, cellulose, acetate-propionate, cellulose acetate-butyrate, ext.). The support may be coated with polymers, including polyvinilidene chloride, acrylic acid type polymers (e.g., polyacrylonitrile, polymethyl acrylate), polymers of unsaturated carboxylic acids (e.g., itaconic acid, acrylic acid), carboxymethyl cellulose and polyacrylamide. Copolymers may also be used. Instead of polymer coating, there may be provided a subbed layer containing a polymer. It is effective to subject the support to an annealing treatment under a relatively low tension to enhance its dimensional stability. For example, there may be optionally combined known techniques described in JP-B no. 60–22616, U.S. Pat. No. 2,779,684, Research disclosure No. 19809, JP-A Nos. 8-211547, 10-10676, 10-10677, 11-47676, 11-65025, 11-138628, 11-138648, 11-221892, 11-333922, and 11-333923. The tension applied to the support at the time of thermal treatment, and preferably at the time of sublayer coating is preferably 0.4 to 80 N/cm$^2$, more preferably 2 to 60 N/cm$^2$, and still more preferably 10 to 50 N/cm$^2$. The thermal treatment temperature or drying temperature is preferably 70 to 220° C., more preferably 80 to 200° C., and still more preferably 90 to 190° C. Thermal treatment time ot drying time is preferably 1 to 30 min., more preferably 2 to 20 min., and still more preferably 3 to 15 min.

One preferred embodiment of the layer arrangement of the invention is that a sublayer is provided on one side of a support, thereon is provided an image recording layer, and further thereon is provided a surface protective layer. The sublayer (of the image recording layer side) is preferably comprised ot at least two layers, and the total dry thickness of the sublayer is preferably 0.2 to 5 μm, and more preferably 0.5 to 3 μm. The dry thickness of the image recording layer is preferably 5 to 13 μm, and more preferably 7 to 11 μm. The dry thickness of the surface protective layer is preferably 2 to 10 μm, and more preferably 4 to 8 μm. The surface protective layer preferably contains a matting agent. The mean particle size of the matting agent is preferably 1 to 10 μm, and more preferably 3 to 7 μm. Commonly known fillers are usable as a matting agent and the use of powdery organic compounds such as polymethyl methacrylate is preferable.

It is also preferred that a sublayer be provided on the opposite side of the support to the image recording layer, thereon be provided a backing layer, and further thereon be provided a backing layer-protective layer. The sublayer (of the backing layer side) is preferably comprised of at least two layers and the layer closest to the support preferably is an antistatic layer containing a electrically conductive metal oxide and/or polymer. The conductive metal oxide is preferably $SnO_2$ which has been surface-treated with Sb and the conductive polymer is preferably a polyaniline. The total dry thickness of the sublayer is preferably 0.2 to 4 μm, and more preferably 0.5 to 2 μm. The dry thickness of the backing layer is preferably 2 to 10 μm, and more preferably 4 to 8 μm. The backing layer preferably contains an antihalation dye. The dry thickness of the backing layer-protective layer is preferably 2 to 10 μm, and more preferably 4 to 8 μm. The backing layer-protective layer preferably contains matting agents. Commonly known fillers are usable as a matting agent and the use of powdery organic compounds such as polymethyl methacrylate is preferable. The mean particle size of the matting agent is preferably 1 to 10 μm, and more preferably 3 to 7 μm. The present invention can be effectively achieved by application of the foregoing layer arrangement and dry layer thickness.

Exposure of photothermographic materials used in the invention can be conducted preferably using an infrared laser at wavelengths of 700 to 1000 nm. After, exposure, thermal processing can be conducted by ultra-rapid access of not more than 45 sec. The thermal processing time, i.e., "top to top" is preferably 5 to 40 sec., and more preferably 5 to 30 sec. The expression "top to top" refers to a time from the time when the top of the photothermographic material is introduced into a film-insertion portion of a thermal processing machine to the time when the top comes out of the thermal processing machine. In one preferred embodiment of the invention, the transport speed in the thermal processing machine is 22 to 40 mm/sec.

EXAMPLES

Embodiments of the present invention will be further described based on examples, but the invention is not limited to these.

Example 1

Preparation of Photothermographic Material

Photothermographic material sample No. 1 was prepared according to the following procedure.

Preparation of a Subbed PET Support

Commercially available biaxially stretched thermally fixed 125 μm polyethylene terephthalate (hereinafter, also denoted as PET) film was subjected to thermal treatment at a temperature of 180° C. and a tension of 1.47×105 Pa for 1 min., while transporting. The PET support exhibited a Young modulus of 7.5×33 $10^9$ Pa in the MD direction (or longitudinal direction) and 7.4×$10^9$ Pa in the TD direction )or traverse direction). Both sides of the thus treated PET film were subjected to corona discharging at 8 w/$m^2$·min. Onto the surface of one side, the subbing coating composition a-1 descried below was applied so as to form a dried layer thickness of 0.8 μm, which was then dried. The resulting coating was designated Subbing Layer A-1. Onto the opposite surface, the subbing coating composition b-1 described below was applied to form a dried layer thickness of 0.8 μm. The resulting coating was designated Subbing Layer B-1.

| Subbing Coating Composition a-1 | |
|---|---|
| Latex solution (solid 30%) of a copolymer consisting of butyl acrylate (30 weight %), t-butyl acrylate (20 weight %) styrene (25 weight %) and 2-hydroxy ethyl acrylate (25 weight %) | 270 g |
| (C-1) | 0.6 g |
| Hexamethylene-1,6-bis (ethyleneurea) | 0.8 g |
| Polystyrene fine particles (av. size, 3 μm) | 0.05 g |
| Colloidal silica (av. particle size, 90 nm) | 0.1 g |
| Water to make | 1 liter |
| **Subbing Coating Composition b-1** | |
| $SnO_2$/Sb (9/1 by weight, av. Size 0.18 μm) | 120 g |
| Latex liquid (solid portion of 30%) of a copolymer consisting of butyl acrylate (30 weight %) styrene (20 weight %) glycidyl acrylate (40 weight %) | 270 g |
| (C-1) | 0.6 g |
| Hexamethylene-1,6-bis (ethyleneurea) | 0.8 g |
| Water to make | 1 liter |

Subsequently, the surfaces of Subbing Layers A-1 and B-1 were subjected to corona discharging with 8 w/$m^2$-minute. Onto the Subbing Layer A-1, the upper subbing layer coating composition a-2 described below was applied so as to form a dried layer thickness of 0.9 μm, which was designated Subbing Layer A-2, while onto the Subbing Layer B-1, the upper subbing layer coating composition b-2 was applied so at to form a dried layer thickness of 0.2 μm, having a static preventing function, which was designated Subbing Upper Layer B-2.

| Upper Subbing Layer Coating Composition a-2 | |
|---|---|
| Gelatin in an amount (weight) to make 0.4 g/$m^2$ | |
| (C-1) | 0.2 g |
| (C-2) | 0.2 g |
| (C-3) | 0.1 g |
| (C-4) | 50 g |
| Filler F1: $TiO_2$ (surface-treated with Al of 1 wt %, based on $TiO_2$, spherical shape, and average particle size of 35 nm) | 0.1 g |
| Water to make | 1 liter |

-continued

| Upper Subbing Layer Coating Composition b-2 |
|---|
| (C-4) 60 g |
| Latex solution (solid 20% comprising) 80 g |
| (C-5) as a substituent |
| Ammonium sulfate 0.5 g |
| (C-6) 12 g |
| Polyethylene glycol (weight-averaged 6 g molecular weight of 600) |
| Water to make 1 liter |

(C-1)

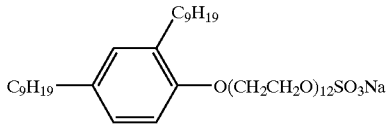

(C-2)

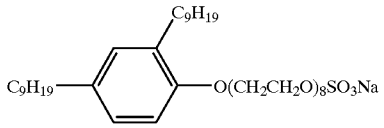

(C-3)

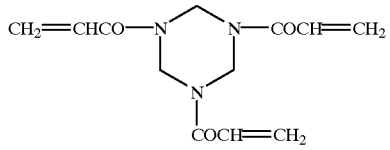

(C-4)

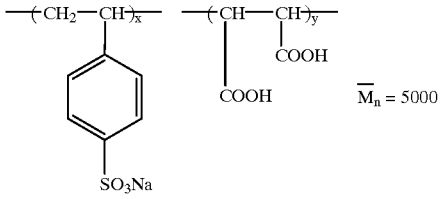

($\overline{M}_n$ is a number average molecular weight)
x:y = 75:25 (weight ratio)

(C-5)

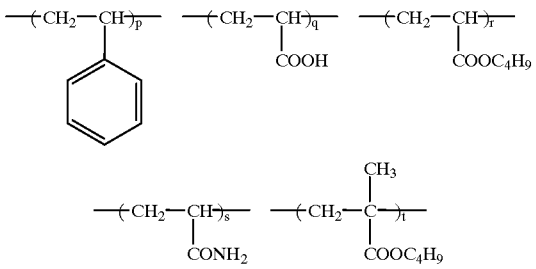

p:q:r:s:t = 40:5:10:5:40 (weight ratio)

(C-6)

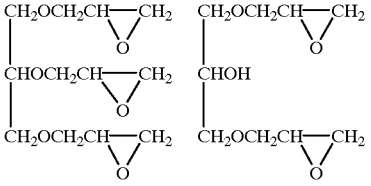

-continued

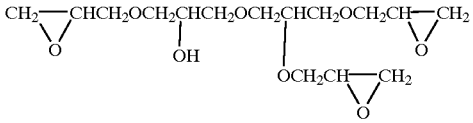

Mixture consisting of the three compounds illustrated above

Thermal Treatment of Support

In the subbing and drying process of the subbed support, the support was heated at 140° C. and then gradually cooled. The support was winded at a tension of 2 kg/cm$^2$.

Preparation of Silver Halide Emulsion A

In 900 ml of deionized water were dissolved 7.5 g of gelatin and 10 mg of potassium bromide. After adjusting the temperature and the pH to 35° C. and 3.0, respectively, 370 ml of an aqueous solution containing 74 g silver nitrate and an equimolar aqueous solution containing sodium chloride, potassium bromide and potassium iodide (in molar ration of 60/38/2), $1\times10^{-6}$ mol/mol Ag of $[Ir(NO)Cl_5]$ and $1\times10^{-6}$ mol/mol Ag of rhodium chloride were added over a period of 10 minutes by the controlled double-jet method, while the pAg was maintained at 7.7. Thereafter, 4-hydroxy-6-methyl-1,3,3a,7-tetraazaindene was added and the pH was adjusted to 8.0 using NaOH and pAg was adjusted to 6.5 to perform reduction sensitization. There was obtained cubic silver iodobromochloride grains having an average grain size of 0.06 $\mu$m, a monodispersity degree of 10%, a variation coefficient of the projection area equivalent diameter of 8%, and the proportion of the {100} face of 87%. The resulting emulsion was flocculated to remove soluble salts, employing a flocculating agent to obtain silver halide emulsion A.

Preparation of Sodium Behenate Solution

In 945 ml water were dissolved 32.4 g of behenic acid, 9.9 g of arachidic acid and 5.6 g of stearic acid at 90° C. Then, after adding 98 ml of 1.5M aqueous sodium hydroxide solution with stirring and further adding 0.93 ml of concentrated nitric acid, the solution was cooled to a temperature of 55° C. and stirred for 30 min. to obtain an aqueous sodium behenate solution.

Preparation of Pre-formed Emulsion

To the aqueous sodium behenate solution described above was added 15.1 g of silver halide emulsion A. After adjusting the pH to 8.1 with aqueous sodium hydroxide, 147 ml of aqueous 1M silver nitrate solution was added thereto in 7 min and after stirring for 20 min., soluble salts were removed by ultrafiltration. Thus obtained silver behenate was comprised of monodisperse needle-like particles having an average long edge length of 0.8 $\mu$m a monodisperse degree of 8%. After forming flock of the dispersion, water was removed therefrom and then, washing and removal of water were repeated six times and finally, drying was conducted.

Preparation of Light Sensitive Emulsion

To the pre-formed emulsion, 544 g of a methyl ethyl ketone/toluene solution (17 wt %) of binder resin A (—$SO_3K$ containing butyral resin exhibiting a Tg of 70° C., in the form of 1 mm diameter pellet) and 107 g of toluene were gradually added. The mixture solution was further dispersed by means of a media type dispersing machine employing 0.5 mm size $ZrO_2$ beads mill, at a rotation pressure of $2.7\times10^7$ Pa and 30° C. for 10 min. to prepare a light sensitive emulsion.

Preparation of Coating Solutions and Coating Thereof

On both sides of the foregoing subbed PET support 1, the following layers were simultaneously coated to prepare sample No. 1, in which drying was conducted at 60° C. for 15 min.

Preparation of Back Coat-side Coating Solution and Coating

Preparation of Coating Solution 1 of Back Coating Layer

| | |
|---|---|
| Binder resin J*1 (10 wt % methyl ethyl ketone solution) | 15 g |
| Dye-A | 0.007 g |
| Dye-B | 0.007 g |
| Matting agent (monodisperse silica having a monodisperse degree of 15% and average particle size of 5 μm) | 0.09 g |
| Matting agent (monodisperse silica having a monodisperse degree of 15% and average particle size of 15 μm) | 0.02 g |
| $C_8F_{17}(CH_2CH_2O)_{12}C_8F_{17}$ | 0.15 g |
| $C_9F_{19}$—$C_6H_4$—$SO_3Na$ | 0.01 g |
| Stearic acid | 0.1 g |

Dye-A

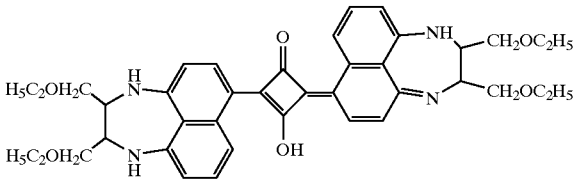

Dye-B

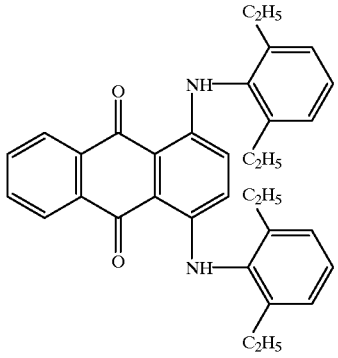

Preparation of Coating Solution 1 of Back Coat-protective Layer

| | |
|---|---|
| Binder resin J*1 (10 wt % methyl ethyl ketone solution) | 15 g |
| Matting agent (monodisperse silica having a monodisperse degree of 15% and average particle size of 5 μm, surface-treated with aluminum of 1% of total silica) | 0.1 g |
| Matting agent (monodisperse silica having a monodisperse degree of 15% and average particle size of 15 μm, surface-treated with aluminum of 1% of total silica) | 0.04 g |
| $C_8F_{17}(CH_2CH_2O)_{12}C_8F_{17}$ | 0.05 g |
| $C_9F_{19}$—$C_6H_4$—$SO_3Na$ | 0.01 g |
| Stearic acid | 0.1 g |

*1binder resin J: cellulose acetate-butyrate resin exhibiting Tg of 110° C., which was determined by differential scanning colorimetry (DSC.)

Back Coat-side Coating

Using coating solutions prepared as above and on the B-2 layer of the support, a backing layer and thereon, a backing layer-protective layer were simultaneously coated so as to form a dry layer thickness of 6 μm and 3.5 μm, respectively.

Preparation of Coating Solution of Image Recording Layer-side and Coating thereof Preparation of Image Recording Layer Coating Solution 1

| | |
|---|---|
| Light sensitive emulsion | 240 g |
| Sensitizing dye-A (10 wt % methanol solution) | 1.7 ml |
| Dye-A | 0.05 g |
| Pyridinium bromide perbromide (6 wt % methanol solution) | 3 ml |
| Calcium bromide (0.1 wt % methanol solution) | 1.7 ml |
| Oxidizing agent-1 (10 wt % methanol solution) | 1.2 ml |
| 2-(4-chlorobenzoyl)benzoic acid (12 wt % methanol solution) | 9.2 ml |
| 2-Mercaptobenzimidazole (1 wt % methanol solution) | 11 ml |
| Tribromomethylsulfoquinoline (5 wt % methanol solution) | 17 ml |
| Hydrazine compound (H-1-1) | 0.4 g |
| Contrast-increasing agent A1 | 0.3 g |
| Phthalazine | 0.6 g |
| 4-Methylphthalic acid | 0.25 g |
| tetrachlorophthalic acid | 0.2 g |
| Filler F1 dispersion*1 | 34.8 g |
| Matting agent (monodisperse silica having a monodisperse degree of 15% and average particle size of 5 μm, surface-treated with aluminum of 1% of total silica) | 0.3 g |
| Reducing agent-1 (20 wt % methanol solution) | 20.5 ml |
| Isocyanate compound (Desmodur N3300, available from Movey Co.) | 0.5 g |
| Stearic acid | 0.5 g |
| Butyl stearate | 0.5 g |
| α-alumina (exhibiting a Morse hardness of 9) | 0.5 g |

*1The dispersion was prepared by adding binder resin A of 10 wt % of filler F1 and a solvent and dispersing by a sand grinder.

Sensitizing dye A

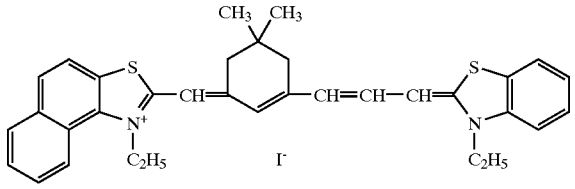

Oxidizing agent-1

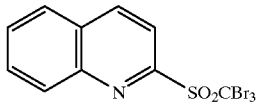

Reducing agent-1

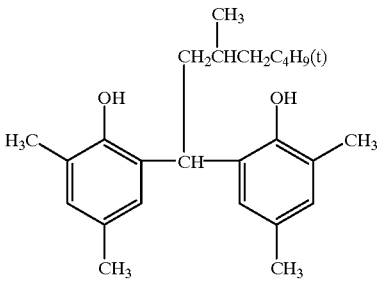

-continued

| Preparation of Coating Solution of Image Recording Layer-side and Coating thereof | |
|---|---|
| Preparation of protective layer coating Solution | |
| Acetone | 5 g |
| Methyl ethyl ketone | 21 g |
| Binder resin J (1 mm diameter pellet, 17 wt % methyl ethyl ketone/toluene solution) | 2.3 g solids |
| methanol | 7 g |
| Phthalazine | 0.25 g |
| Filler F1 dispersion (50% solids) | 0.8 g |
| Reducing agent-1 (20 wt % methanol solution) | 10 ml |
| Matting agent (monodisperse silica having a monodisperse degree of 15% and average particle size of 5 μm, surface-treated with aluminum of 1% of total silica) | 0.5 g |
| Matting agent (monodisperse silica having a monodisperse degree of 15% and average particle size of 20 μm, surface-treated with aluminum of 1% of total silica) | 0.04 g |
| $CH_2{=}CHSO_2CH_2CH_2OCH_2CH_2SO_2CH{=}CH_2$ | 0.035 g |
| fluorinated surfactant $C_{12}F_{25}(CH_2CH_2O)_{10}C_{12}F_{25}$ | 0.01 g |
| $C_8F_{17}{-}C_6H_4{-}SO_3Na$ | 0.01 g |
| Stearic acid | 0.1 g |
| Butyl stearate | 0.1 g |
| α-alumina (exhibiting a Morse hardness of 9) | 0.1 g |

Coating of Image Recording Layer-side

On the A-2 layer of the support, the foregoing coating solutions were simultaneously coated so as to form an image recording layer having a silver coverage of 1.0 g/m$^2$ and dry layer thickness of 10.0 μm, and a protective layer of a dry layer thickness of 6 μm to obtain sample No. 1.

Further, photothermographic material samples Nos. 2 through 10 were prepared similarly to sample No. 1, provided a filler, binder resins used in the image recording layer and the protective layer, and hydrazine derivatives and a contrast-increasing agent used in the image recording layer were varied as shown in Table 1.

Binder resin B: polyurethane having a cyclohexane ring containing $-SO_3Na$ (being made from diphenylmethanediisocyanate/neopentyl glycol/ethylene glycol/cylohexyldimethanol/isophthalic acid/phthalic acid=11/22/3/22/29/13, by weight ratio and exhibiting Tg=73° C.; commercial name UR-8200, product by TOYOBO Co., Ltd.), Binder resin C: polyurethane having a cyclohexane ring containing $-SO_3Na$ (being made from diphenylmethanediisocyanate/neopentyl glycol/1,6-hexanediol/ethylene glycol/isophthalic acid/phthalic acid/polycaprolactone=13/16/14/1/14/8/34, by weight ratio and exhibiting Tg=23° C.; commercial name UR-8300, product by TOYOBO Co., Ltd.), Binder resin D: acryl resin having a cyclohexane ring containing $-SO_3Na$ (acryl resin of phenyl methacrylate/4-hydroxyphenyl methacrylamide/3-cyanophenyl methacrylamide=3/4/3 by weight ratio and exhibiting Tg=110° C.), Binder resin E: acryl resin having a cyclohexane ring containing $-SO_3Na$ (acryl resin of benzyl methacrylate/4-hydroxyphenyl methacrylamide/3-cyanophenyl methacrylamide=3/4/3 by weight ratio and exhibiting Tg=95° C.), Binder resin G: acryl resin having a cyclohexane ring containing $-SO_3Na$ (acryl resin of benzyl methacrylate/ethyl acrylate/acrylonitrile/methacrylic acid=3/3/2/2 by weight ratio and exhibiting Tg=45° C.), Binder resin I: phenoxy resin (PKHH: Tg=105° C., product by Union Carbide Co.).

Sample No. 11 was prepared similarly to Sample No. 1, provided that the support was replaced by a PET film which was thermally treated under a tension of 9.8×10$^5$ Pa.

Each sample was cut to a size of 30 cm in width and 50 cm in length, in the dark room and wound up on a cardboard core having an internal diameter of 10 cm. Further thereon was wound a packaging material of a size of 60 cm×2 m to prepare a sample for use in evaluation. Form each of the thus prepared samples, binders contained in the component layers including an image recording layer were removed using an appropriate solvent and organic silver salt particles were electron-microscopically measured through the replica technique with respect to particle size. It was proved that 90% of the total organic silver salt particles was accounted for by

TABLE 1

| Sample No. | Support | Hydrazine | Contrast-increasing Agent | Filler | Binder: Image recording Layer | Binder: Protective Layer | Transport Speed at Thermal Processing (mm/s) | Remark |
|---|---|---|---|---|---|---|---|---|
| 1 | Support 1 | H-1-1 | A1 | F1 | A | J | 35 | Inv. |
| 2 | Support 1 | H-1-1 | A1 | F2 | A | J | 35 | Inv. |
| 3 | Support 1 | H-1-1 | A1 | F3 | A | J | 35 | Inv. |
| 4 | Support 1 | H-1-1 | A1 | F1 | E | D | 35 | Inv. |
| 5 | Support 1 | H-1-1 | A1 | F1 | B | D | 35 | Inv. |
| 6 | Support 1 | H-1-1 | A1 | F1 | E | I | 35 | Inv. |
| 7 | Support 1 | H-2-1 | B1 | F1 | A | J | 35 | Inv. |
| 8 | Support 1 | H-3-1 | C1 | F1 | A | J | 35 | Inv. |
| 9 | Support 1 | H-4-1 | D1 | F1 | A | J | 35 | Inv. |
| 10 | Support 1 | H-1-1 | D1 | — | C | G | 35 | Comp. |
| 11 | Support 2 | H-1-1 | A1 | F1 | A | J | 35 | Inv. |
| 12 | Support 1 | H-1-1 | A1 | F1 | A | J | 20 | Inv. |
| 13 | Support 1 | H-1-1 | A1 | F1 | A | J | 45 | Inv. |

In Table 1, compounds shown in Table 1 are as below.

Filler F2: $SnO_2$ (surface-treated with 1 wt % Sb, based on $SnO_2$, and needle crystals having an average major axis length of 150 nm and a acicular ratio of 8;

Filler F3: Mica (having an average particle size of 200 nm and a tabular ratio of 5);

tabular particles having a major axis length of 0.5±0.05 μm. a minor axis length of 0.4±0.05 μm and a thickness of 0.01 μm and exhibiting a monodisperse degree of 5%.

Exposure and Thermal Processing of Photothermographic Material

The thus prepared Samples Nos. 1 through 11 were each subjected to half tone dot exposure at 300 lines per inch using an image setter machine installed with a 780 nm semiconductor laser, Dolev 2 Dry (available from Scitex Corp.) with varying exposure at 5% intervals. Exposed samples were allowed to pass through the per-heating section at 110° C. for 15 sec. and then further allowed to be horizontally transported in the oven at 120° C. for 15 sec. Exposure and thermal processing were carried out in an atmosphere of 23° C. and 50% RH. In the thermal processor, the longest non-contact transport length was 18 cm and the transport rate was 35 mm/sec.

Further, using Sample No. 1, thermal processing was similarly conducted, provided that the transport speed was varied to 20 mm/sec or 45 mm/sec (Sample Nos. 12 and 13).

Characteristic Evaluation of Thermally Processed Sample

Thermally processed Samples Nos. 1 through 13 were evaluated in the following manner.

Ultra-micro Hardness and Vickers Hardness

The outermost surface of the image recording layer side was measured with respect to the ultra-micro hardness and Vickers hardness, using ultra-micro hardness tester MHA-400 (available from NIPPON DENKI Co., Ltd.) according to the following conditions. Thus, the indentator (diamond triangular pyramidal needle) of the ultra-micro hardness tester was indented onto the sample surface through a piezoelectric actuator under the following condition and the ultra-micro hardness and the Vickers hardness were determined from the indentation depth and indenting load of the indentator.

Indentator form: a triangular indentator having an edge angle of 80°

Load: maximum $50\times10^{-5}$ Newton

Indentation speed: 12 nm/sec

Measurement environment: 25° C., 60% RH

Indentation depth: not more than 5 μm from the surface

When indented with load W, the indented depth is designated as X and hardness H(ε) at a depth of ε meets the following equation, and this hardness H is designated as ultra-micro hardness (GPa) and its value is shown as characteristic value-1 in Table 2:

$$W(X) = \alpha \int_{o}^{x} H(\varepsilon)(X-\varepsilon)d\varepsilon$$

where α is a constant. Further, a homogeneous material exhibiting no variation in hardness gives $W(X)=\frac{1}{2}(\alpha HX^2)$ and the graph of the square of indentation depth X versus load W(X) forms a straight line. From the slope of the straight line, the ultra-micro hardness (GPa) was determined and converted to a Vickers hardness. The thus obtained Vickers hardness is shown as characteristic value 2 in Table 2. The ultra-micro hardness (characteristic value 1) and Vickers hardness (characteristic value-2) are values obtained at a depth of 0.5 μm from the surface.

Determination of Dimensional Variation

The dimensional variation rate between before and after thermal processing was determined in accordance with the following procedure.

1) Samples each were cut to 12×15 cm and allowed to stand under an atmosphere of 25° C. and 60% RH for at least 4 hrs.

2) Paired holes were perforated at 10 cm intervals in the MD direction (longitudinal direction) and in the TD direction (traverse direction) and each spacing between paired holes was measured by a pingauge and the obtained value was designated as $L_1$.

3) After being thermally processed according to the processing conditions described above, samples were again allowed to stand under an atmosphere of 25° C. and 60% RH for at least 4 hrs.

4) The spacing was again measured by a pingauge and the obtained value was designated as $L_2$.

5) Using the thus determined $L_1$ and $L_2$, dimensional variations in the MD direction and in the TD direction were determined according to the following equation:

$$\text{Dimensional variation rate (\%)}=\{100\times(L_2-L_1)/L_1\}$$

In Table 2, the dimensional variation rate in the MD direction is designated as characteristic value-3 and that in the TD direction is designated as characteristic value-4.

Determination of Center-line Mean Roughness

Unprocessed and processed samples each were measured with respect to center-line mean roughness of the surface of the image recording layer side, in accordance with the following procedure. Thus, the center-line mean roughness, Ra (expressed in nm) of an area of 368×238 μm using a non-contact three-dimensional surface analysis apparatus (RST/PLUS, available from WYKO Corp.). The Ra was defined, based on JIS surface roughness (B0601). The determination was conducted in such a manner that each sample of 30×30 cm was divided into 100 sections by cross-cutting at 3 cm intervals, the central portion of each square section was measured for roughness and the mean value and a standard deviation was determined from the 100 measured values. When the roughness curve was expressed by Y=f(X), the center-line mean roughness (Ra) is defined as a value in nanometer (nm), that is obtained from equation 1 described earlier, extracting a part of measuring length L in the direction of its center-line from the roughness curve, and taking the center-line of this extracted part as the X-axis and the direction of vertical magnification as the Y-axis.

The thus obtained center-line mean roughness, $Ra_1$ (expressed in nm) of the image recording layer side surface of each of thermally unprocessed samples is shown in Table 2, designated as characteristic value-5; and the center-line mean roughness, $Ra_2$ (expressed in nm) of the image recording layer side surface of each of the thermally processed samples is also shown in Table 2, designated as characteristic value-6. Further, the difference (ΔRa) between $Ra_1$ and $Ra_2$ is designated as characteristic value-7, as shown in Table 2.

Determination of Dmax and γ

Thermally processed photothermographic material samples each were measured through a filter cutting light having wavelengths of 420 nm or more using a densitometer (PD-6, available from Konica Corp.) and a characteristic curve comprising an abscissa-exposure (Log E) and an ordinate-optical density (D) was obtained. The slope (tan θ) of a straight line connecting two points corresponding to densities of 0.3 and 3.0 on the thus obtained characteristic curve was defined as γ and the density at the maximum density portion was designated as Dmax. Respective values are shown in Table 2.

Evaluation of Roller Mark

Thermally processed samples were visually evaluated with respect to roller marks occurred during thermal development, based on the following criteria. Results thereof are shown in Table 2.

1: roller marks were observed allover the sample,

2: scattered distinct roller marks were observed,

3: scattered slight roller marks were observed,

4: isolated very slight roller marks were observed,

5: no roller mark was observed.

In the above ranks, only ranks 4 and 5 are acceptable levels of practical use.

Evaluation of Unevenness in Density

Thermally processed samples were evaluated with respect to unevenness in density, based on the following criteria:

1: distinct unevenness in density was observed overall on the sample,

2: scattered but distinct unevenness in density was observed,

3: scattered slight unevenness in density was observed,

4: isolated and very slight unevenness in density was observed,

5: no unevenness in density was observed.

In the above ranks, only ranks 4 and 5 are acceptable levels of practical use.

The thus evaluated results are summarized in Table 2.

TABLE 2

| Sample No. | Value-1 (GPa) | Value-2 (H) | Value-3 (%) | Value-4 (%) | Value-5 $Ra_1$ (nm) | Value-6 $Ra_2$ (nm) | Value-7 ΔRa (nm) | Dmax | γ | Roller Mark | Unevenness in Density | Remark |
|---|---|---|---|---|---|---|---|---|---|---|---|---|
| 1 | 2.8 | 123 | 0.01 | 0.015 | 140 | 142 | 2 | 4.8 | 15.1 | 5 | 5 | Inv. |
| 2 | 2.6 | 117 | 0.01 | 0.015 | 145 | 148 | 3 | 4.7 | 14.9 | 4 | 4 | Inv. |
| 3 | 2.2 | 101 | 0.01 | 0.015 | 147 | 152 | 5 | 4.7 | 14.9 | 4 | 4 | Inv. |
| 4 | 3.1 | 132 | 0.01 | 0.015 | 135 | 138 | 3 | 4.8 | 15.1 | 5 | 5 | Inv. |
| 5 | 2.8 | 123 | 0.01 | 0.015 | 137 | 139 | 2 | 4.9 | 15.2 | 5 | 5 | Inv. |
| 6 | 2.2 | 101 | 0.01 | 0.015 | 146 | 149 | 3 | 4.8 | 15.1 | 5 | 5 | Inv. |
| 7 | 2.8 | 123 | 0.01 | 0.015 | 140 | 142 | 2 | 4.9 | 15.6 | 5 | 5 | Inv. |
| 8 | 2.8 | 123 | 0.01 | 0.015 | 140 | 142 | 2 | 4.7 | 15.0 | 5 | 5 | Inv. |
| 9 | 2.8 | 123 | 0.01 | 0.015 | 140 | 142 | 2 | 5.0 | 15.4 | 5 | 5 | Inv. |
| 10 | 1.0 | 54 | 0.01 | 0.015 | 142 | 156 | 14 | 4.5 | 14.6 | 2 | 2 | Comp. |
| 11 | 2.8 | 123 | 0.05 | 0.05 | 140 | 146 | 6 | 4.7 | 14.9 | 4 | 3 | Inv. |
| 12 | 2.8 | 123 | 0.01 | 0.015 | 140 | 147 | 7 | 4.9 | 15.1 | 3 | 4 | Inv. |
| 13 | 2.8 | 123 | 0.01 | 0.015 | 140 | 142 | 2 | 4.3 | 14.6 | 4 | 3 | Inv. |

As can be seen from Table 2, it was proved that photothermographic material having characteristics relating to the invention or photothermographic material processed by the processing method relating to the invention led to minimized roller marks and unevenness in density, enhanced maximum density (Dmax) and extremely high contrast characteristics, as compared to the comparative sample.

Example 2

Photothermographic material sample No. 14 was prepared in accordance with the following procedure.

Preparation of Silver Halide Emulsion B

In 700 ml of water were dissolved 22 g of phthalated gelatin and 30 mg of potassium bromide. After adjusting the temperature and the pH to 40° C. and 5.0, respectively, 159 ml of an aqueous solution containing 18.6 g silver nitrate and 159 ml of an aqueous equimolar potassium bromide solution were added by the controlled double jet addition in 10 min., while maintaining the pAg at 7.7. Then, an aqueous silver nitrate solution and an aqueous solution containing $8\times10^{-6}$ mol/l of $K_3[IrCl_6]$ and 1 mol/l of potassium bromide were added by the double jet addition in 30 min., while maintaining the pAg at 7.7. Thereafter, the pH and pAg were adjusted to 5.9 and 8.0, respectively. There were obtained cubic silver halide grains having an average grain size of 0.07 μm, a variation coefficient of the projection area equivalent diameter of 8%, and the proportion of the {100} face of 86%.

The thus obtained silver halide grain emulsion was heated to 60° C. and ripened for 120 min. with $8.5\times10^{-5}$ mol of sodium thiosulfate, $1.1\times10^{-5}$ mol of 2,3,4,5,6-pentafluorophenyldiphenyl-phosphine selenide, $2\times10^{-6}$ mol of tellurium compound-1 and $3.3\times10^{-6}$ mol of chloroauric acid and $2.3\times10^{-4}$ mol thiocyanic acid, each per mol of silver. Thereafter, the temperature was lowered to 50° C., then, $8\times10^{-4}$ mol/mol Ag of sensitizing dye B was added thereto with stirring. Subsequently was added thereto potassium iodide of $3.5\times10^{-2}$ mol, based on silver and after stirring for 30 min., the emulsion was cooled to 30° C. to obtain silver halide grain emulsion B.

Tellurium compound-1

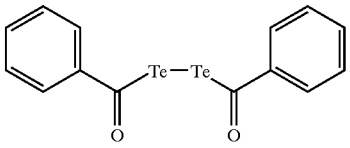

Sensitizing dye B

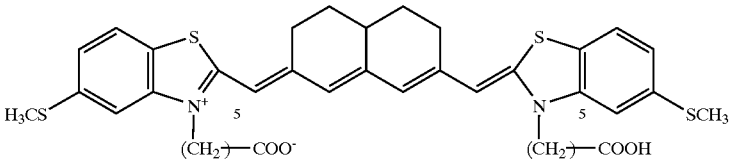

Preparation of Microcrystalline Organic Silver Salt Dispersion

Behenic acid of 40 g, stearic acid of 7.3 g were stirred with 500 ml water at 90° C. for 15 min. and 187 ml of an aqueous 1 mol/l sodium hydroxide solution was added thereto in 15 min., then, 61 ml of an aqueous 1 mol/l silver nitrate solution was further added, and the temperature was lowered to 50° C. Subsequently, 124 ml of an aqueous 1 mol/l silver nitrate solution was added thereto and further stirred for 5 min. The solid product was filtered using a suction funnel and then subjected to water washing until the conductivity of the filtrate reached 30 μS/cm. The thus obtained solid was treated in a wet cake form, without being dried. To the wet cake equivalent to 34.8 g of dried solid, 120 g of polyvinyl alcohol and 150 ml water were added with stirring to form slurry. The slurry was added into a vessel together with 840 g of zirconia beads having an average diameter of 0.5 mm and dispersed for 5 hrs. by a dispersing machine (¼ Sand Grinder Mill, available from IMEX Co. Ltd.) in 5 hr. to obtain an microcrystalline organic silver salt dispersion, which was comprised of non-monodisperse organic silver salt microcrystals exhibiting a volume-averaged size of 1.5 μm and a dispersion degree of 55%. The particle size was measured using Master Saizer X, available from Malvern Instrument Co., Ltd.

Preparation of Fine Solid Particle Dispersion of Materials

A fine solid particle dispersion of tetrachlorophthalic acid, 4-methylphthalic acid, reducing agent-1, phthalazine or tribromomethylsulfonylbenzene was prepared. Thus, to tetrachlorophthalic acid were added 0.81 g f hydroxypropylcellulose and 94.2 ml water with stirring and was allowed to stand in the form of a slurry for 10 hrs. Thereafter, 100 ml of zirconia beads having an average diameter of 0.5 mm was added together with the slurry to the vessel and dispersed in 5 hrs. the same type dispersing apparatus as used in the preparation of the silver salt microcrystal dispersion to obtain a tetrachlorophthalic acid microcrytal dispersion, in which 70 wt % of the fine solid particles exhibited a size of 1.0 μm or less. With regard to other materials, solid particle dispersions were obtained in a similar manner, provided that the amount of a surfactant and the dispersing time were optimally varied to obtain an intended average particle size.

Preparation of Coating Solution and Coating

On subbed PET support 1 prepared in Example 1, the following coating solutions were simultaneously coated to prepare sample No. 14. The binder resin and filler used in the upper sublayer coating solution, a-2 were the same as used in the image recording layer coating solution.

Preparation of Backing Layer Coating Solution 2

| | |
|---|---|
| Polyvinyl alcohol (10 wt % aq. solution) | 15 g |
| Dye-A | 0.007 g |
| Dye-B | 0.007 g |
| Matting agent (monodisperse silica having a monodisperse degree of 15% and average particle size of 5 μm) | 0.09 g |
| Matting agent (monodisperse silica having a monodisperse degree of 15% and average particle size of 17 μm) | 0.01 g |
| Sodium dodecybenzenesulfonate | 0.05 g |
| Stearic acid | 0.1 g |

-continued

Preparation of Coating Solution 2 of Back Coat-protective Layer

| | |
|---|---|
| Polyvinyl alcohol (10 wt % aq. solution) | 15 g |
| Matting agent (monodisperse silica having a monodisperse degree of 15% and average particle size of 5 μm, surface-treated with aluminum of 1% of total silica) | 0.1 g |
| Matting agent (monodisperse silica having a monodisperse degree of 15% and average particle size of 15 μm, surface-treated with aluminum of 1% of total silica) | 0.04 g |
| Stearic acid | 0.1 g |

Back Coat-side Coating

Using coating solutions prepared as above and on the B-2 layer of the support 1, a backing layer and thereon, a backing layer-protective layer were simultaneously coated so as to form a dry layer thickness of 6 μm and 3.5 μm, respectively. Drying was conducted at 60° C. for 15 min.

Preparation of Image Recording Layer Coating Solution

| | |
|---|---|
| Microcrystalline organic silver salt dispersion | 0.95 mol |
| Silver halide emulsion B | 0.05 mol |
| Binder resin E | 430 g solids |
| Reducing agent-1 | 98 g |
| Tribromomethylsulfonylbenzene | 12 g |
| Hydrazine derivative (H-1-1) | 1.5 g |
| contrast-increasing agent, Compound A1 | 1.5 g |
| Phthalazine | 9.2 g |
| 4-Methylphthalic acid | 7 g |
| Tetrachlorophthalic acid | 5 g |
| Filler F1 dispersion*1 | 143.3 g |
| Matting agent (monodisperse silica having a monodisperse degree of 15% and average particle size of 5 μm, surface-treated with aluminum of 1% of total silica) | 2.0 g |
| Stearic acid | 0.5 g |
| Butyl stearate | 0.5 g |
| α-alumina (exhibiting a Morse hardness of 9) | 0.5 g |

Preparation of Protective Layer Coating Solution 2

| | |
|---|---|
| Water | 26 g |
| Binder resin G | solids 2.3 g |
| Phthalazine | 0.25 g |
| Reducing agent-1 | 10 g |
| Matting agent (monodisperse silica having a monodisperse degree of 15% and average particle size of 5 μm, surface-treated with aluminum of 1% of total silica) | 0.5 g |
| Matting agent (monodisperse silica having a monodisperse degree of 15% and average particle size of 20 μm, surface-treated with aluminum of 1% of total silica) | 0.04 g |
| $C_8F_{17}$—$C_6H_4$—$SO_3Na$ | 0.02 g |
| Stearic acid | 0.1 g |
| Butyl stearate | 0.1 g |
| α-alumina (exhibiting a Morse hardness of 9) | 0.1 g |

*1The dispersion was prepared by adding binder resin A of 10 wt % of filler F1 and a solvent and dispersing by a sand grinder.

Coating of Image Recording Layer-side

On the A-2 layer of the support 1, the foregoing coating solutions were simultaneously coated so as to form an image recording layer having a silver coverage of 1.0 g/m$^2$ and dry layer thickness of 10.0 μm, and a protective layer of a dry layer thickness of 6 μm to obtain sample No. 14.

Further, photothermographic material samples Nos. 15 through 21 were prepared similarly to sample No. 1, provided a filler, binder resins used in the image recording layer and the protective layer, and hydrazine derivatives and a contrast-increasing agent used in the image recording layer were varied as shown in Table 3.

TABLE 3

| Sample No. | Support | Hydrazine | Contrast-increasing Agent | Filler | Binder: Image recording Layer | Binder: Protective Layer | Transport Speed at Thermal Processing (mm/s) | Remark |
|---|---|---|---|---|---|---|---|---|
| 14 | Support 1 | H-1-1 | A1 | F1 | E | D | 35 | Inv. |
| 15 | Support 1 | H-1-1 | A1 | F1 | G | D | 35 | Inv. |
| 16 | Support 1 | H-1-1 | A1 | F2 | E | D | 35 | Inv. |
| 17 | Support 1 | H-1-1 | A1 | F3 | E | D | 35 | Inv. |
| 18 | Support 1 | H-2-1 | B1 | F1 | E | D | 35 | Inv. |
| 19 | Support 1 | H-3-1 | C1 | F1 | E | D | 35 | Inv. |
| 20 | Support 1 | H-4-1 | D1 | F1 | E | D | 35 | Inv. |
| 21 | Support 1 | H-1-1 | A1 | — | H | F | 35 | Comp. |

In Table 3, compounds other than those used in Example 1 are as follows.

Binder resin F: copolymer of methyl methacrylate/styrene/2-ethylhexyl acrylate/2-hydroxyethyl methacrylate/methacrylic acid=59/9/25/5/1, Tg=47° C.

Binder resin H: Raxter 3307B (available from DAINIPPON INK KAGAKUKOGYO Co., Ltd., Tg=13° C.).

Each sample was cut to a size of 30 cm in width and 50 cm in length, in the dark room and wound up on a cardboard core having an internal diameter of 10 cm. Further thereon was wound a packaging material of a size of 60 cm×2 m to prepare a sample for use in evaluation. Form each of the thus prepared samples, binders contained in the component layers including an image recording layer were removed using an appropriate solvent and organic silver salt particles were electron-microscopically measured through the replica technique with respect to particle size. It was proved that 90% of the total organic silver salt particles was accounted for by tabular particles having a major axis length of 0.5±0.05 μm a minor axis length of 0.4±0.05 μm and a thickness of 0.01 μm and exhibiting a monodisperse degree of 5%.

Exposure, Thermal Processing and Evaluation

Similarly to Example 1, photothermographic material samples Nos. 14 through 21 were subjected to exposure and thermal processing. Unprocessed samples and thermally processed samples were each evaluated, similarly to Example 1, with respect to ultra-micro hardness, Vickers hardness, dimensional stability (in the MD and TD directions), center-line mean roughness, maximum density, γ, roller mark and unevenness in density. Results thereof are shown in Table 4.

Similarly to Example 1, it was proved from Table 4 that photothermographic material having characteristics relating to the invention or photothermographic material processed by the processing method relating to the invention led to minimized roller marks and unevenness in density, enhanced maximum density (Dmax) and extremely high contrast characteristics, as compared to the comparative sample.

EFFECT OF THE INVENTION

According to the present invention were provided photothermographic materials causing no roller mark nor unevenness in density and exhibiting relatively high maximum density and high contrast, even when subjected to rapid processing, and a processing method by the use thereof.

Disclosed embodiments can be varied by a skilled person without departing from the spirit and scope of the invention.

What is claimed is:

1. A photothermographic material comprising a support and an image recording layer comprising an organic silver salt, a silver halide, a reducing agent and a binder, wherein the outermost surface of the image recording layer side of the photothermographic material exhibits a difference in center-line mean roughness of not more than 10 nm between before and after being subjected to imagewise exposure and thermal processing.

2. The photothermographic material of claim 1, wherein an absolute value of a thermal dimensional variation rate between before and after being subjected to the thermal processing is 0.001 to 0.04% in both the longitudinal direction and the traverse direction.

3. The photothermographic material of claim 1, wherein a protective layer is provided on the image recording layer side and farther from the support than the image recording layer.

4. The photothermographic material of claim 3, wherein the protective layer comprises a binder exhibiting a glass

TABLE 4

| Sample No. | Value-1 (GPa) | Value-2 (H) | Value-3 (%) | Value-4 (%) | Value-5 $Ra_1$ (nm) | Value-6 $Ra_2$ (nm) | Value-7 ΔRa (nm) | Dmax | γ | Roller Mark | Unevenness in Density | Remark |
|---|---|---|---|---|---|---|---|---|---|---|---|---|
| 14 | 3.2 | 135 | 0.01 | 0.015 | 137 | 138 | 1 | 5.1 | 15.4 | 5 | 5 | Inv. |
| 15 | 3.2 | 135 | 0.01 | 0.015 | 137 | 138 | 1 | 5.1 | 15.4 | 5 | 5 | Inv. |
| 16 | 2.8 | 123 | 0.01 | 0.015 | 139 | 141 | 2 | 4.9 | 15.2 | 4 | 5 | Inv. |
| 17 | 2.4 | 109 | 0.01 | 0.015 | 142 | 145 | 3 | 4.9 | 15.1 | 4 | 5 | Inv. |
| 18 | 3.2 | 135 | 0.01 | 0.015 | 137 | 138 | 1 | 5.4 | 15.7 | 5 | 5 | Inv. |
| 19 | 3.2 | 135 | 0.01 | 0.015 | 137 | 138 | 1 | 5.0 | 15.1 | 5 | 5 | Inv. |
| 20 | 3.2 | 135 | 0.01 | 0.015 | 137 | 138 | 1 | 5.6 | 15.9 | 5 | 5 | Inv. |
| 21 | 1.0 | 54 | 0.01 | 0.015 | 142 | 155 | 13 | 4.5 | 14.4 | 2 | 3 | Comp. |

transition point of 75 to 200° C., and the binder of the image recoding layer exhibiting a glass transition point of 45 to 150° C.

5. The photothermographic material of claim 1, wherein the outermost surface of the image recording layer side of the photothermographic material exhibits an ultra-micro hardness of 1.1 to 4.0 GPa.

6. The photothermographic material of claim 1, wherein the image recording layer further comprises a filler.

7. The photothermographic material of claim 3, wherein the protective layer comprises a filler.

8. The photothermographic material of claim 1, wherein at least 50% by weight of the binder contained in the image recording layer is accounted for by a polymeric latex.

9. The photothermographic material of claim 8, wherein the image recording layer is formed by using a coating solution of the image recording layer, the coating solution containing water in an amount of at least 30% by weight, based on a solvent contained in the coating solution.

10. A processing method of a photothermographic material comprising the step of:

subjecting an imagewise exposed a photothermographic material comprising a support and an image recording layer comprising an organic silver salt, a silver halide, a reducing agent and a binder to and thermal processing by use of a thermal processing machine, wherein the outermost surface of the image recording layer side of the photothermographic material exhibits a difference in center-line mean roughness of not more than 10 nm between before and after being subjected to thermal processing.

11. The processing method of claim 10, wherein the processing machine transports the photothermographic material at a rate of 22 to 40 mm/sec.

* * * * *